US009717959B2

(12) United States Patent
Stites

(10) Patent No.: US 9,717,959 B2
(45) Date of Patent: Aug. 1, 2017

(54) GOLF CLUBS AND GOLF CLUB HEADS

(75) Inventor: John T. Stites, Weatherford, TX (US)

(73) Assignee: KARSTEN MANUFACTURING CORPORATION, Phoenix, AZ (US)

( * ) Notice: Subject to any disclaimer, the term of this patent is extended or adjusted under 35 U.S.C. 154(b) by 1169 days.

(21) Appl. No.: 12/572,709

(22) Filed: Oct. 2, 2009

(65) Prior Publication Data

US 2010/0267461 A1 Oct. 21, 2010

Related U.S. Application Data

(63) Continuation-in-part of application No. 12/427,510, filed on Apr. 21, 2009.

(51) Int. Cl.
*A63B 53/00* (2015.01)
*A63B 53/04* (2015.01)

(52) U.S. Cl.
CPC ..... *A63B 53/0466* (2013.01); *A63B 53/047* (2013.01); *A63B 2053/005* (2013.01); *A63B 2053/045* (2013.01); *A63B 2053/0408* (2013.01); *A63B 2053/0412* (2013.01); *A63B 2053/0433* (2013.01); *A63B 2053/0441* (2013.01); *A63B 2053/0454* (2013.01); *A63B 2053/0491* (2013.01); *A63B 2209/02* (2013.01); *A63B 2225/01* (2013.01)

(58) Field of Classification Search
USPC ..... 473/345, 349–350; D21/755, 752, D21/748–749
See application file for complete search history.

(56) References Cited

U.S. PATENT DOCUMENTS

| | | | | |
|---|---|---|---|---|
| 2,087,685 A | | 7/1937 | Hackney | |
| 2,859,972 A | * | 11/1958 | Reach | 473/242 |
| 3,814,437 A | | 6/1974 | Winquist | |
| 4,671,513 A | * | 6/1987 | Swanson | 473/328 |
| 4,715,601 A | | 12/1987 | Lamanna | |
| 4,802,672 A | | 2/1989 | Long | |

(Continued)

FOREIGN PATENT DOCUMENTS

| | | |
|---|---|---|
| JP | 59-161852 | 10/1984 |
| JP | 08-024373 A | 1/1996 |

(Continued)

OTHER PUBLICATIONS

International Search Report and Written Opinion dated Jul. 28, 2010 issued in corresponding PCT/US2010/030186.

(Continued)

*Primary Examiner* — Gene Kim
*Assistant Examiner* — Matthew B Stanczak
(74) *Attorney, Agent, or Firm* — Banner & Witcoff, Ltd.

(57) ABSTRACT

Golf clubs and golf club head structures having an indicator providing a visual indication of a location of a center of gravity of a wood-type golf club are presented. The indicator may include a central portion or hub that is generally aligned with the center of gravity of the club. The indicator may also include a plurality of legs extending outward from the hub toward a perimeter of the golf club head. In some arrangements, the indicator may be formed to distribute a portion of the weight of the club head in order to adjust or move the center of gravity of the club head, in addition to providing a visual indication of the location of the center of gravity.

31 Claims, 16 Drawing Sheets

(56) References Cited

U.S. PATENT DOCUMENTS

| | | | | | |
|---|---|---|---|---|---|
| 4,809,977 | A | * | 3/1989 | Doran et al. | 473/249 |
| 4,883,274 | A | | 11/1989 | Hsien | |
| 4,907,806 | A | | 3/1990 | Antonious | |
| 4,915,386 | A | | 4/1990 | Antonious | |
| 4,919,430 | A | | 4/1990 | Antonious | |
| 4,923,197 | A | | 5/1990 | Schacht | |
| 4,932,658 | A | | 6/1990 | Antonious | |
| 5,014,993 | A | | 5/1991 | Antonious | |
| D318,703 | S | | 7/1991 | Shearer | |
| 5,046,733 | A | | 9/1991 | Antonious | |
| 5,242,167 | A | | 9/1993 | Antonious | |
| 5,290,032 | A | | 3/1994 | Fenton et al. | |
| 5,295,686 | A | | 3/1994 | Lundberg | |
| 5,306,008 | A | * | 4/1994 | Kinoshita | 473/242 |
| D348,091 | S | | 6/1994 | Allen | |
| 5,328,184 | A | | 7/1994 | Antonious | |
| 5,333,872 | A | | 8/1994 | Manning et al. | |
| 5,377,985 | A | | 1/1995 | Ohnishi | |
| 5,401,021 | A | | 3/1995 | Allen | |
| 5,447,307 | A | | 9/1995 | Antonious | |
| 5,524,880 | A | | 6/1996 | Kobayashi | |
| 5,547,194 | A | | 8/1996 | Aizawa et al. | |
| 5,549,297 | A | | 8/1996 | Mahaffey | |
| 5,595,552 | A | | 1/1997 | Wright et al. | |
| 5,643,099 | A | | 7/1997 | Solheim | |
| D385,003 | S | * | 10/1997 | Burrows | D21/752 |
| 5,695,411 | A | * | 12/1997 | Wright et al. | 473/332 |
| 5,697,855 | A | | 12/1997 | Aizawa | |
| D390,294 | S | * | 2/1998 | Burrows | D21/752 |
| D390,295 | S | * | 2/1998 | Burrows | D21/752 |
| 5,716,288 | A | | 2/1998 | Sacco | |
| 5,823,887 | A | | 10/1998 | Mikame et al. | |
| D401,299 | S | * | 11/1998 | Burrows | D21/733 |
| 5,851,159 | A | * | 12/1998 | Burrows | 473/345 |
| 5,851,160 | A | | 12/1998 | Rugge et al. | |
| 5,916,042 | A | | 6/1999 | Reimers | |
| D413,642 | S | * | 9/1999 | Burrows | D21/752 |
| D413,953 | S | * | 9/1999 | Burrows | D21/752 |
| D418,887 | S | | 1/2000 | Williams, Jr. | |
| 6,015,354 | A | | 1/2000 | Ahn et al. | |
| 6,089,994 | A | | 7/2000 | Sun | |
| 6,277,032 | B1 | | 8/2001 | Smith | |
| 6,379,262 | B1 | | 4/2002 | Boone | |
| 6,422,951 | B1 | * | 7/2002 | Burrows | 473/328 |
| 6,454,665 | B2 | | 9/2002 | Antonious | |
| 6,923,732 | B2 | | 8/2005 | Stites et al. | |
| D512,757 | S | | 12/2005 | Cleveland et al. | |
| 7,048,647 | B2 | | 5/2006 | Burrows | |
| 7,201,669 | B2 | | 4/2007 | Stites et al. | |
| 7,235,023 | B2 | | 6/2007 | Sugimoto | |
| 7,704,155 | B2 | * | 4/2010 | Bennett et al. | 473/245 |
| 7,744,487 | B2 | | 6/2010 | Tavares et al. | |
| 2002/0082108 | A1 | | 6/2002 | Peters et al. | |
| 2003/0199331 | A1 | | 10/2003 | Stites, III | |
| 2004/0018890 | A1 | | 1/2004 | Stites et al. | |
| 2004/0204263 | A1 | | 10/2004 | Fagot et al. | |
| 2005/0137024 | A1 | | 6/2005 | Stites | |
| 2007/0099720 | A1 | | 5/2007 | Gillig | |
| 2007/0207878 | A1 | | 9/2007 | Tavares et al. | |
| 2009/0118034 | A1 | | 5/2009 | Yokota | |
| 2010/0267461 | A1 | | 10/2010 | Stites | |
| 2010/0267463 | A1 | | 10/2010 | Stites | |

FOREIGN PATENT DOCUMENTS

| | | | |
|---|---|---|---|
| JP | 09-173508 | | 7/1997 |
| JP | 10-127832 | A | 5/1998 |
| JP | 2000-126337 | A | 5/2000 |
| JP | 2000-229138 | A | 8/2000 |
| JP | 2007-044087 | | 2/2007 |
| JP | 2007516047 | A | 6/2007 |
| WO | 2005063340 | A1 | 7/2005 |

OTHER PUBLICATIONS

International Search Report and Written Opinion issued on Feb. 7, 2011 in corresponding PCT/US2010/050478.

Office Action issued Jan. 24, 2012 in parent U.S. Appl. No. 12/427,510.

International Preliminary Report on Patentability issued in International Application No. PCT/US2010/030186, mialed Nov. 4, 2011.

International Preliminary Report on Patentability issued in International Application No. PCT/US2010/050478, dated Apr. 3, 2012.

International Preliminary Report on Patentability and Written Opinion issued in related International Application No. PCT/US2010/029310, dated Oct. 4, 2011.

International Search Report issued in related International Application No. PCT/US2010/029310, dated Aug. 3, 2010.

Office Action issued Apr. 3, 2012 in related U.S. Appl. No. 13/099,016.

Office Action issued Jul. 20, 2012 in related U.S. Appl. No. 12/427,510.

Non-Final Office Action, issued May 20, 2013, in corresponding U.S. Appl. No. 12/427,510.

Notice of Reasons for Rejection, issued Jun. 24, 2013, in corresponding Japanese Patent Application No. 2012-507244.

First Office Action dated Jul. 10, 2013, in corresponding Chinese Application No. 201080017695.4.

Final Office Action dated Oct. 7, 2013, in corresponding U.S. Appl. No. 12/427,510.

Non-Final Office Action issued in corresponding U.S. Appl. No. 12/427,510, dated Mar. 3, 2014.

Notice of Reasons for Rejection issued in corresponding Japanese Application No. 2012-507244, dated May 28, 2014.

English Translation of Notice of Reasons for Rejection issued in corresponding Japanese Application No. 2012-507244, dated May 28, 2014.

* cited by examiner

GOLF CLUBS AND GOLF CLUB HEADS

CROSS REFERENCE TO RELATED APPLICATIONS

This U.S. patent application is a continuation-in-part of U.S. patent application Ser. No. 12/427,510 entitled "Golf Clubs and Golf Club Heads," filed Apr. 21, 2009 and incorporated herein by reference in its entirety.

FIELD OF THE DISCLOSURE

The present disclosure relates to golf clubs and golf club heads. Particular example aspects of this disclosure relate to golf clubs and golf club heads having indicators for indicating particular regions and/or features of the golf club head.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, there is room in the art for further advances in golf club technology.

SUMMARY OF THE DISCLOSURE

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Golf club heads according to at least some example aspects of this disclosure include: an iron-type golf club head body having a ball striking face and a rear surface opposite the ball striking face (e.g., including a perimeter weighting member extending rearward from the ball striking face and along at least a portion of a circumferential area of the golf club head body). Also, the golf club head body may include an indicator. According to some aspects of this disclosure, the indicator may be a multi-legged bridge member. Further, in accordance with at least some examples of this disclosure, the multi-legged bridge member may indicate the precise location of the center of gravity of the golf club head.

A set of golf club heads in accordance with at least some examples of this disclosure may include club head bodies that have varying centers of gravity depending on the particular club head body. In such golf club head bodies, the multi-legged bridge members may be shaped differently to indicate the location of the center of gravity for each respective club head body.

According to some aspects of this disclosure, the differently shaped multi-legged bridge members can be used to alter the center of the gravity of the club head body. For example, due to the multi-legged bridge member's weighting characteristics (weight, density, etc.), the shape of the multi-legged bridge member will redistribute the weight of the golf club head body and thereby shift the club head body's center of gravity. Therefore, the multi-legged bridge member can be selectively shaped to control features of the club head's center of gravity.

Additional aspects of this disclosure relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head. Other steps also may be included in these methods, such as engaging a grip member with the shaft member, club head body finishing steps, etc.

Still other aspects of this disclosure related to wood-type golf club heads having an indicator providing a visual indication of the location of the center of gravity of the golf club head. The indicator may include a hub region that may be generally vertically aligned with the center of gravity (when the club head is oriented at its designed lie angle and in a ball address orientation) and a plurality of legs extending outward from the hub toward a perimeter of the golf club head. In some arrangements, the indicator may be formed to redistribute weight associated with the golf club head in order to shift the center of gravity of the golf club head, in addition to providing a visual indication of the location of the center of gravity of the golf club head.

BRIEF DESCRIPTION OF THE DRAWINGS

The present disclosure is illustrated by way of example and not limited in the accompanying figures, in which like reference numerals indicate similar elements throughout, and in which.

Figure 1:
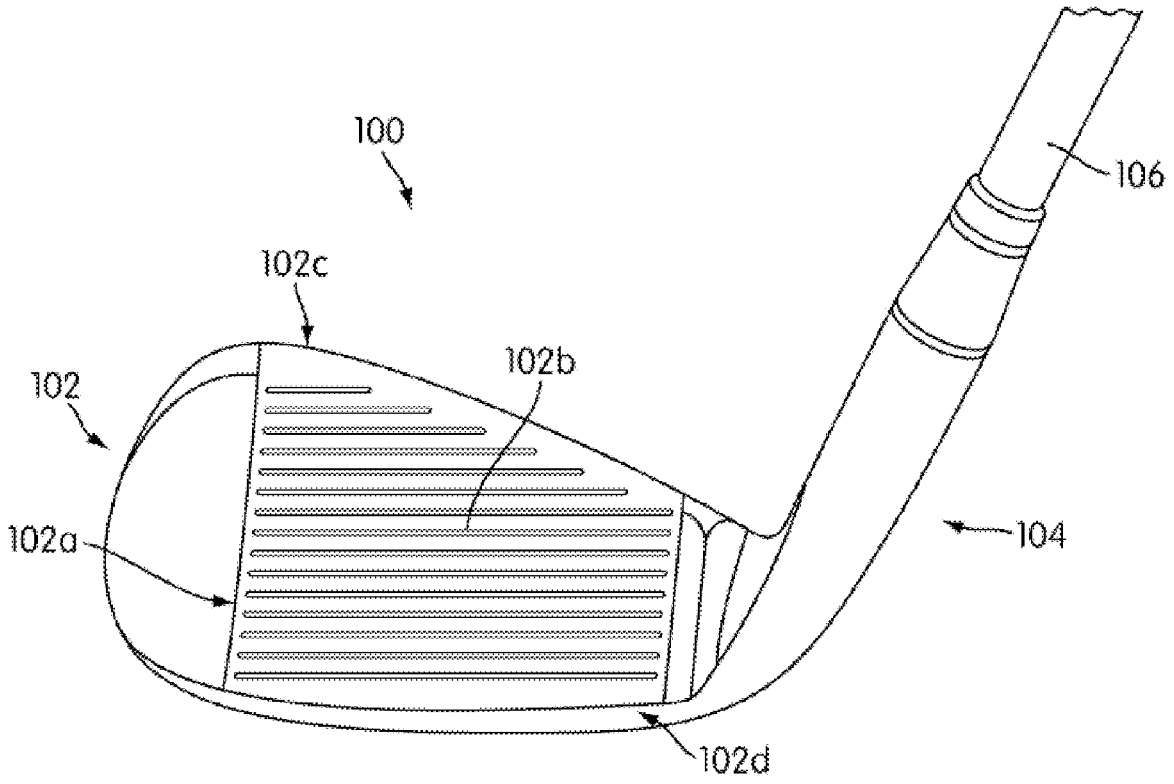
FIG. 1 generally illustrates features of a golf club structure according to at least some examples of this disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. General Description of Example Golf Club Heads, Golf Clubs, and Methods in Accordance with this Disclosure As described above, aspects of this disclosure relate to iron-type golf club heads and golf clubs. Iron-type golf club heads according to at least some example aspects of this disclosure may include: (a) an iron-type golf club head body; (b) a ball striking face; (c) a rear surface opposite the ball striking face, optionally including a perimeter weighting member extending rearward from the ball striking face and along at least a portion of a circumferential area of the golf club head body; and (d) a multi-legged bridge member which indicates a particular region of the golf club head body.

According to aspects of this disclosure, the multi-legged bridge member may indicate the location of the center of gravity of the golf club head body. Therefore, according to such aspects of this disclosure, in a set of golf clubs wherein each golf club head body has a different center of gravity, the multi-legged bridge member for each golf club head body may be different (e.g., differently shaped) in order to reflect the different location of the center of gravity of each particular golf club head body in the set. For example, because the center of gravity location of a golf club head body for a pitching wedge may be different than the center of gravity location of a golf club head body for a 5-iron, the multi-legged bridge member for the pitching wedge indicates a location which is different from the location indicated by the multi-legged bridge member on the 5-iron.

According to aspects of this disclosure, the multi-legged bridge member itself, at least in part, may affect the location of the center of gravity of the golf club head body. For example, the weight of the multi-legged bridge member may affect the location of the center of gravity of the golf club head body. Further, the multi-legged bridge members may have different weights, different densities, different weight distributions, and/or other different weighting characteristics relative to the rest of the club head body. Therefore, according to such aspects of this disclosure, the multi-legged bridge member may be oriented and/or shaped to alter the center of gravity of the club head body. In other words, the orientation and/or shape of the multi-legged bridge member can be controlled in order to provide a particular center of gravity for a golf club head body. As described below, providing a particular center of gravity for a golf club head body can be advantageous.

According to some aspects of this disclosure, the multi-legged bridge members in "long" iron type golf clubs (i.e., irons with a relatively low degree of loft, e.g., a 3-iron) may be shaped to provide a center of gravity of the golf club head body which is closer to the heel of the club head body than to the toe (i.e., near the hosel). Such a configuration decreases the distance from the hosel to the center of gravity of the golf club head body. Because the center of gravity is closer to the hosel, the golfer can more quickly and easily rotate the golf club head body (e.g., from an open club face position to a closed club face position). Hence, such a configuration can aid a golfer in imparting "draw" trajectory to the golf ball. For example, a "draw" is a golf shot in which, for a right handed golfer, the golf ball will have "right to left" trajectory. The ball flight for a "draw" tends to have less back spin and, therefore, the ball tends to roll further once it lands. Also, "draws" tend to exhibit lower ball flights. These aspects of a "draw" (i.e., less back spin, further roll and lower ball flight) tend to increase the distance that the golf ball will travel upon being struck by the golfer. Therefore, providing the center of gravity of the golf club head body near the heel can increase the distance of a golf shot, which may be particularly useful in "long" irons.

According to some other aspects of this disclosure, the multi-legged bridge members in "short" iron type golf clubs (i.e., irons with a relatively high degree of loft, e.g., a 9-iron, wedges, etc.) may be shaped to provide a center of gravity of the golf club head body which is closer to the toe of the club head body than to the heel. Such a configuration increases the distance from the hosel to the center of gravity of the golf club head body. Because the center of gravity is further away from the hosel, the golfer may not be able to rotate the golf club head body as quickly or easily (e.g., from an open club face position to a closed club face position). Therefore, the stability of the golf shot may be increased. Hence, such a configuration can aid a golfer in imparting "fade" trajectory to the golf ball. For example, a "fade" is a golf shot in which, for a right handed golfer, the golf ball will have "left to right" trajectory. The ball flight for a "fade" tends to have more back spin and, therefore, the ball tends to roll less once it lands. Also, "fades" tend to exhibit higher ball flights. These aspects of a "fade" (i.e., more back spin, less roll and higher ball flight) tend to stop the ball from rolling. Therefore, providing the center of gravity of the golf club head body near the toe can aid the golfer in stopping the ball from rolling when it lands on the green, which may be particularly useful in "short" irons.

According to some other aspects of this disclosure, the multi-legged bridge members in "middle" iron type golf clubs (i.e., irons with a relatively intermediate degree of loft, e.g., a 5-iron) may be shaped to provide the center of gravity of the golf club head body generally near the center of the club head body. Such a configuration can create a relatively intermediate distance from the hosel to the center of gravity of the golf club head body. Because the center of gravity is at a relatively intermediate distance from the hosel (e.g., near the center of the golf club head body) the "middle" irons may have some characteristics from each of the above described "long" and "short" irons (e.g., further distance and better ball control), but not to the same extent.

Additional aspects of this disclosure relate to iron-type golf club structures that include golf club heads, e.g., of the types described above. Such iron-type golf club structures further may include one or more of: a shaft member attached to the club head (optionally via a separate hosel member or a hosel member provided as a part of one or more of the club head and/or shaft); a grip or handle member attached to the shaft member; additional weight members; medallions; vibration dampening structures; etc.

Still additional aspects of this disclosure relate to methods for producing iron-type golf club heads and iron-type golf club structures in accordance with examples of this disclosure. Such methods may include, for example, one or more of the following steps in any desired order and/or combinations: (a) providing a golf club head body of the various types described above (including any or all of the various structures, features, and/or arrangements described above), e.g., by manufacturing or otherwise constructing the golf club head body, by obtaining the golf club head body from a third party source, etc.; (b) engaging a shaft member with the golf club head body; and (c) engaging a grip member with the shaft member.

Still other aspects of this disclosure relate to golf club heads having wood-type golf club head bodies. The golf club head may also include an indicator formed in a sole portion of the wood type golf club head body. In at least some examples, the indicator may include a hub positioned vertically below the center of gravity of the golf club head when the golf club head is oriented at its designed lie angle and in a ball address orientation, the hub providing a visual indication of a location of the center of gravity. In some arrangements, the indicator may further include a plurality of legs extending outward from the hub toward a perimeter of the golf club head body. In at least some examples, the legs may taper as they extend from the hub to the perimeter of the golf club head. In some arrangements of this disclosure the indicator or portions thereof may be formed of a material that is heavier or more dense than the material making up the remainder of the golf club head (or the material making up a majority of the golf club head) in order to shift or adjust the center of gravity of the golf club head.

Additional aspects of the disclosure relate to golf club heads that may include a wood-type golf club head body including at least a sole portion, a top portion, a toe edge, a heel edge, a ball striking portion and a rear edge. The golf club head may further include an indicator formed in the wood-type golf club head body indicating a center of gravity of the golf club head. In some examples, the indicator may include a hub that is generally aligned with the center of gravity of the club head and a plurality of legs extending outward from the hub toward a perimeter of the club. The indicator may, in some arrangements, be formed in the sole portion of the club head body.

Still other aspects of the disclosure relate to a golf club head including a wood-type golf club head body including at least a heel edge, a toe edge and a ball striking face. In at least some examples, the golf club head may include a sole plate connected to the club head body and including an indicator providing a visual indication of a center of gravity of the golf club head, the indicator including a hub portion generally aligned vertically with the center of gravity when the golf club head is oriented at its designed lie angle and at a ball address orientation. In some arrangements, the sole plate may include a plurality of recesses that indicate a general area of the center of gravity. In still other examples, the sole plate indicator may include a hub that is generally aligned with the center of gravity of the golf club head.

Given the general description of various example aspects of the disclosure provided above, more detailed descriptions of various specific examples of golf clubs and golf club head structures according to the disclosure are provided below.

II. Detailed Description of Example Golf Club Heads, Golf Club Structures, and Methods According to the Disclosure The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures illustrated in FIGS. 1-4B.

FIG. 1 generally illustrates an example of an iron-type golf club 100 and golf club head body 102 in accordance with the present disclosure. In addition to the golf club head body 102, the overall golf club structure 100 of this example includes a hosel region 104, a shaft member 106 received in and/or inserted into and/or through the hosel region 104, and a grip or handle member (not shown) attached to the shaft member 106. Optionally, if desired, the external hosel region 104 may be eliminated and the shaft member 106 may be directly inserted into and/or otherwise attached to the head member 102 (e.g., through an opening provided in the top of the club head body 102, through an internal hosel member (e.g., provided within an interior chamber defined by the club head body 102), etc.). The hosel member 104 may be integrally formed as part of the club head structure 102, or it may be separately formed and engaged therewith (e.g., by adhesives or cements; by welding, brazing, soldering, or other fusing techniques; by mechanical connectors; etc.). Conventional hosels and their inclusion in an iron type club head structure may be used without departing from this disclosure.

The shaft member 106 may be received in, engaged with, and/or attached to the club head body 102 in any suitable or desired manner, including in conventional manners known and used in the art, without departing from the disclosure. As more specific examples, the shaft member 106 may be engaged with the club head body 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into or through the club head body 102; etc. If desired, the shaft 106 may be connected to the head 102 in a releasable manner using mechanical connectors to allow easy interchange of one shaft for another on the head.

The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member (not shown) may be attached to, engaged with, and/or extend from the shaft member 106 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member (not shown) may be integrally formed as a unitary, one-piece construction with the shaft member 106. Additionally, any desired grip or handle member materials may be used without departing from this disclosure, including, for example: rubber materials, leather materials, rubber or other materials including cord or other fabric material embedded therein, polymeric materials, and the like.

The club head body 102 itself also may be constructed in any suitable or desired manner and/or from any suitable or desired materials without departing from this disclosure, including from conventional materials and/or in conventional manners known and used in the art. For example, in the example structure shown in FIG. 1, the club head body 102 includes a ball striking face member 102*a* (including a ball striking face plate 102*b* integrally formed with the face member 102*a* or attached to a frame member such that the face plate 102*b* and frame member together constitute the overall face member 102*a*). The club head body 102 of this illustrated example further includes a top, or crown, portion 102*c* and a sole portion 102*d*. The club head body 102 and/or its various parts may be made by forging, casting, molding, and/or using other techniques and processes, including techniques and processes that are conventional and known in the art.

A wide variety of overall club head constructions are possible without departing from this disclosure. For example, if desired, some or all of the various individual parts of the club head body 102 described above may be made from multiple pieces that are connected together (e.g., by adhesives or cements; by welding, soldering, brazing, or other fusing techniques; by mechanical connectors; etc.). The various parts (e.g., top portion 102*c*, sole portion 102*d*, etc.) may be made from any desired materials and combinations of different materials, including materials that are conventionally known and used in the art, such as metal materials, including lightweight metal materials, composite materials, polymer materials, etc.

The dimensions and/or other characteristics of a golf club head structure 102 according to examples of this disclosure may vary significantly without departing from the disclosure. For example, any iron type club head may be provided including, for example: iron type hybrid clubs, driving irons, 0 through 10 irons, wedges (e.g., pitching wedges, lob wedges, gap wedges, sand wedges, etc.), chipping clubs, etc.

Figure 2A:
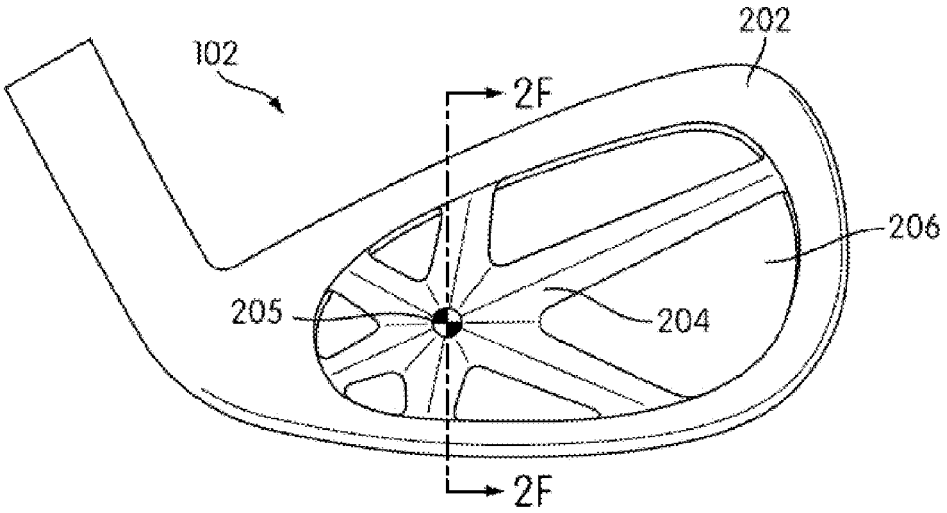
FIGS. 2A-C illustrate golf club head structures according to at least some examples of this disclosure.
Figure 2B:
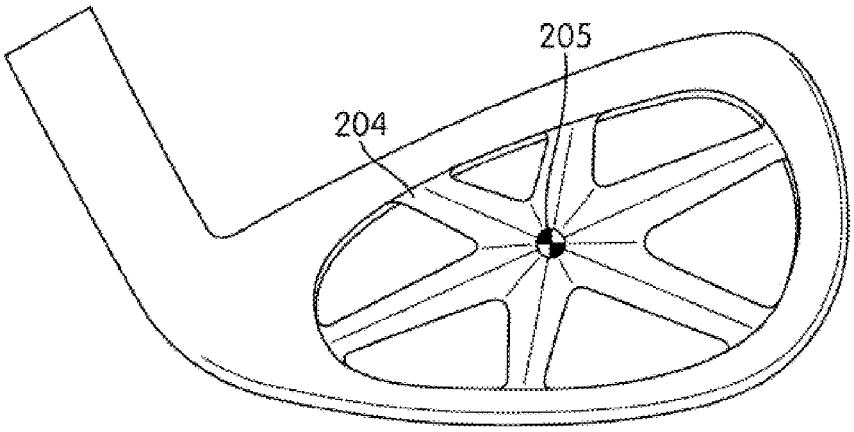
Figure 2C:
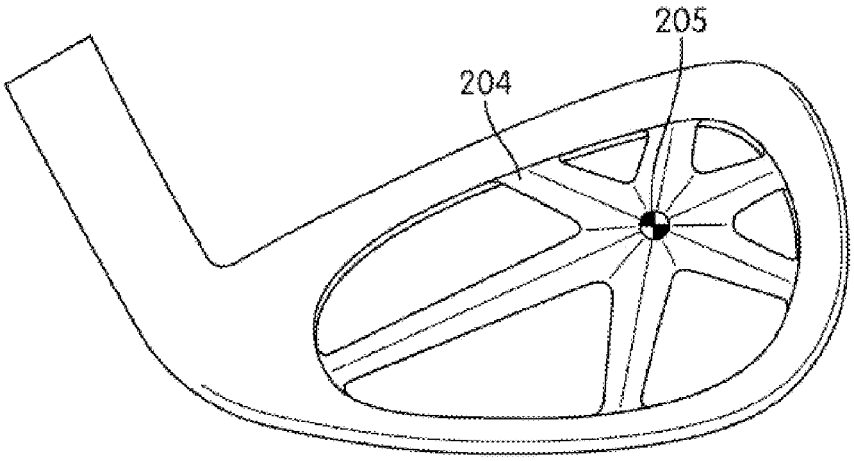
Figure 2D:
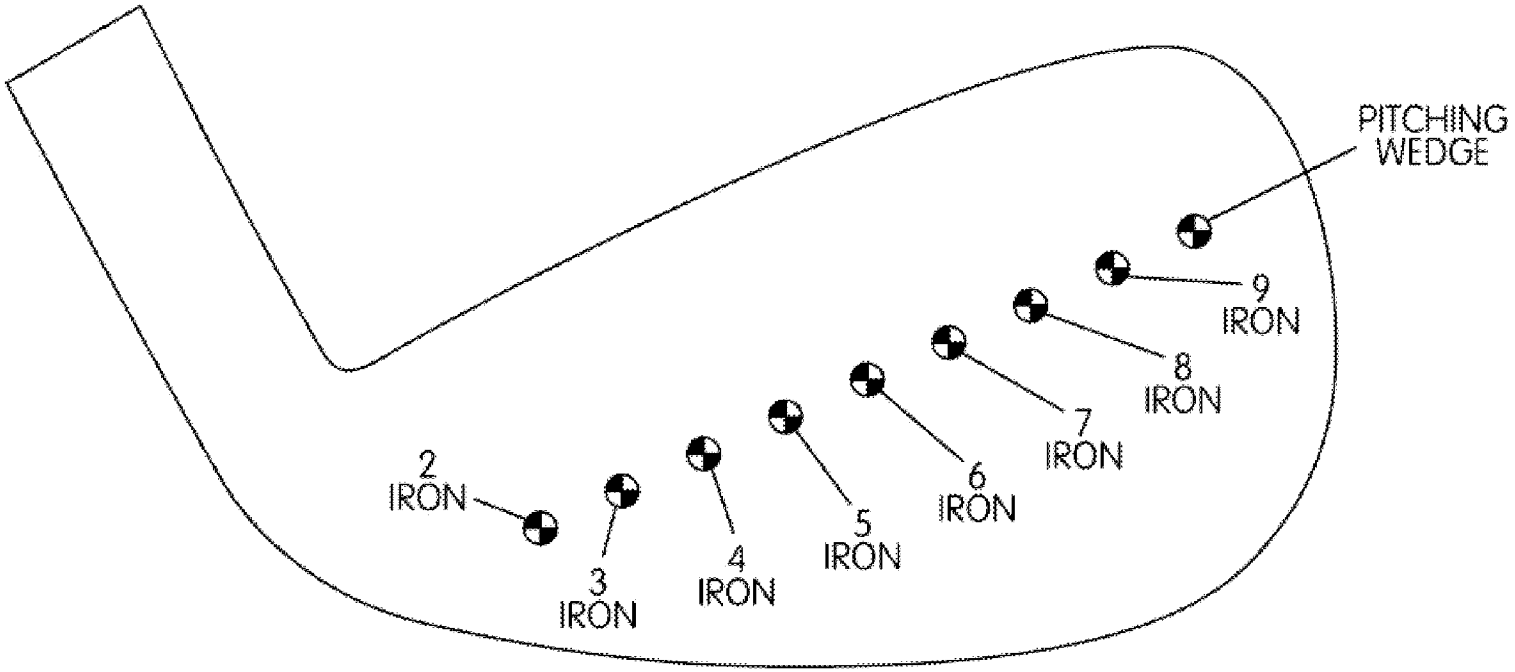
FIG. 2D schematically shows a progression of the centers of multi-legged bridge members of club head bodies in a set of golf clubs according to examples of this disclosure.
Figure 2E:
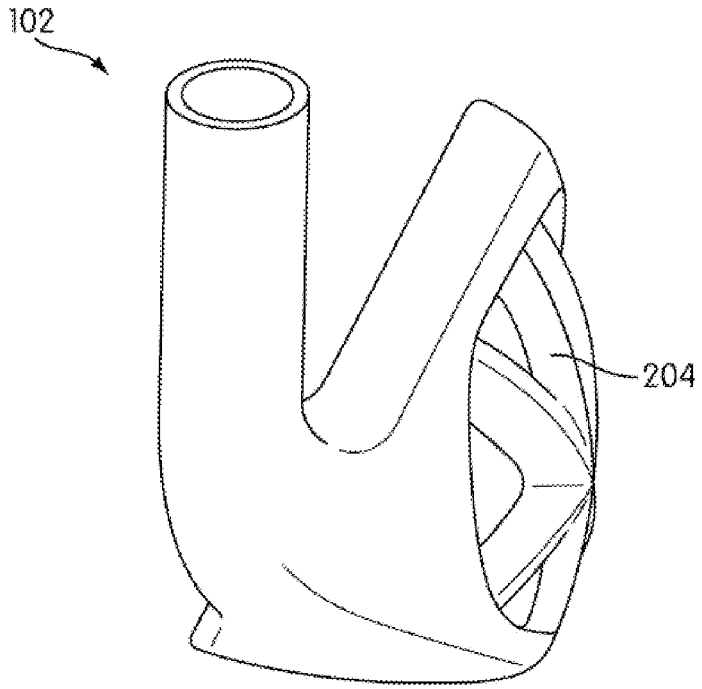
FIG. 2E illustrates a perspective heel end view of golf club head structure according to at least some examples of this disclosure.
Figure 2F:
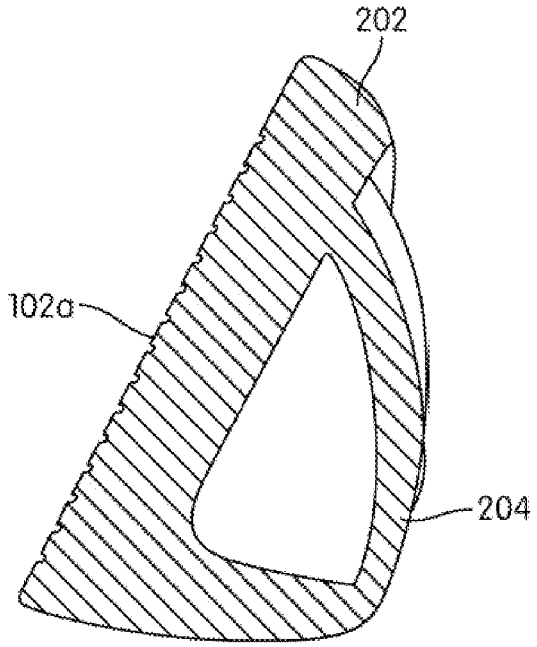
FIG. 2F illustrates a cross sectional view of golf club head structure shown in FIG. 2A.

FIGS. 2A-F illustrate example features and structures that may be included in golf clubs and golf club head bodies in accordance with examples of this disclosure. As seen in FIGS. 2A-C, the golf club head body 102 may include a perimeter weighting member 202. As shown in FIGS. 2E-F, the perimeter weighting member 202 may extend rearwardly from the ball striking face 102*a* and along at least a portion of a circumferential area of the golf club head body 102.

Further, according to aspects of this disclosure, the golf club head body 102 may include a multi-legged bridge member 204 which indicates the golf club head body's center of gravity (denoted symbolically at reference numeral 205). According to some aspects of this disclosure, and as seen in FIGS. 2A-C, the multi-legged bridge member 204 may be either a portion of the perimeter weighting member 202 of the golf club head body 102 or a separate element (e.g., made from the same or different materials as the perimeter weighting member) that is attached to the perimeter weighting member 202. For example, in the first case wherein the multi-legged bridge member 204 is a portion of the perimeter weighting member 202, during manufacture of the golf club head bodies 102, the golf club head bodies including the multi-legged bridge members 204 could be formed (e.g., in a mold). In the second case, wherein the multi-legged bridge member 204 is a separate element that is attached to the golf club head body 102, then during manufacture of the golf club head bodies 102, or, alternatively, after manufacture (e.g., during a club fitting), the multi-legged bridge members 204 could be selectively attached to the club head bodies 102. For example, the multi-legged bridge member 204 could be attached to the club head body in a variety of ways including: via adhesives, cements, welding, soldering, mechanical connectors (such as threads, retaining elements, snap fit, or the like), etc. If desired, the multi-legged bridge member 204 may be attached to the club head body 102 in a releasable manner using mechanical connectors to allow easy interchange of multi-legged bridge member 204 for another. It is noted that in such embodiments a tool may be used to attach and/or release the interchangeable multi-legged bridge member 204 from the club head body 102. In either case, such structures of the multi-legged bridge member 204 may be positioned at least along the top, bottom or side portions of the perimeter weighting member 202 and may form a substantial portion of at least one of the top, bottom or side of the perimeter weighting member 202.

In the depicted embodiment, the multi-legged bridge member 204 extends over a cavity 206 in the rear portion of the club head body 102. Further, as seen in the depicted embodiment, the multi-legged bridge member 204 has a "star" shape with six legs that extend out from the "center" of the "star" (i.e., the point where the legs of the "star" converge, also referred to herein as a "hub") to the perimeter weighting member 202. Hence, as shown, the multi-legged bridge member 204 has six points of contact with the perimeter weighting member 202 and, further, contacts each of the top, bottom and sides of the perimeter weighting member 202. Therefore, as can be seen, the multi-legged bridge member 204 extends from the heel to the toe and from the crown portion to the sole portion of the golf club head body 102. The "center" of the "star" (i.e., the point where the legs converge) is positioned over the golf club head body's center of gravity 205. Further, according to at least some aspects of this disclosure, as the legs extend from the perimeter weighting member 202 toward the "center" of the "star", the legs extend away from the face of the golf club head body 102. In this way, the "center" of the "star" defines an apex of the multi-legged bridge member 204. Hence, in such embodiments, the apex will, at least generally, identify a location of the golf club head body's center of gravity 205.

According to some aspects of this disclosure, the "center" of the "star" or the apex of the "star" will indicate the precise location of the golf club head body's center of gravity 205. This allows the golfer to actually see the position of the center of gravity for each golf club body in the set (e.g., during practice). Hence, when the golfer uses the golf club (e.g., during a round), the golfer will know that the center of gravity for each golf club body in the set is correct (i.e., in the correct position).

According to some aspects of this disclosure, in a set of golf clubs wherein each golf club head body has a different center of gravity location, the multi-legged bridge member 204 for each golf club head body 102 in the set may be different (e.g., a differently shaped element) in order to reflect the different locations of the centers of gravity of each particular golf club head body in the set. For example, FIGS. 2A-C illustrate golf club head bodies of such a set of golf clubs. FIG. 2A is an illustrative embodiment of a golf club head body 102 for a "long" iron (e.g., a 3-iron), FIG. 2B is an illustrative embodiment of a golf club head body 102 for a "middle" iron (e.g., a 5-iron), and FIG. 2C is an illustrative embodiment of a golf club head body 102 for a "short" iron (e.g., a 9-iron). As can be seen by comparing FIGS. 2A, 2B and 2C, the different golf club head bodies each have a different center of gravity location 205 and, further, the multi-legged bridge members 204 are shaped to reflect the different locations of the respective centers of gravity 205 for the different golf club head bodies. FIG. 2D schematically shows an entire progression of the position of the "centers" or apexes of the multi-legged bridge members 204 in a set of golf clubs according to an illustrative embodiment of this disclosure. It is noted that the schematic rendering shown in FIG. 2D is not to scale and, instead, is used merely to give the reader a sense of the general progression of the location of the center of gravity for one embodiment of this disclosure. As seen in FIG. 2D, the progression begins as a 2-iron (one of the club head bodies with a low degree of loft relative to the set of club head bodies) with the center of gravity 205 located generally toward the lower heel end of the club head body 102. The progression continues from the lower heel toward the upper toe of the club head body 102 until the progression ends as a pitching wedge (one of the club head bodies with a high degree of loft relative to the set of club head bodies) with the center of gravity 205 located generally toward the upper toe end of the club head body 102. In this way, the multi-legged bridge member 204 of each golf club head body reflects the different center of gravity for each particular golf club head body 102 in the set of golf clubs. It is noted of course, that this is merely one illustrative embodiment of a set of golf clubs according to this disclosure and other sets of golf clubs according to this disclosure may include other clubs, such as sand wedges, lob wedges, hybrids irons, etc. Further, it is noted that other desired progressions or arrangements of the center of gravity may be provided without departing from this disclosure.

According to some aspects of this disclosure, in addition to merely indicating the location of the center of gravity of the club head body 102, the shape of the multi-legged bridge member 204 can be used to alter (e.g., shift) the center of the gravity of the club head body 102. For example, due to the multi-legged bridge member's weighting characteristics (weight, density, etc.), the shape of the multi-legged bridge member 204 will redistribute the weight of the golf club head body 102 (as compared to the golf club head body without the multi-legged bridge member 204) and thereby shift the club head body's center of gravity 205. Therefore, the multi-legged bridge member 204 can be selectively shaped and, if needed, selectively attached to the club head body 102 to control features of the club head's center of gravity 205.

For example, depending on the shape of the multi-legged bridge member 204, the location of the center of gravity of the club head body may be adjusted both vertically and horizontally. For example, relative to the club head body 102 in which the multi-legged bridge member 204 is included, the multi-legged bridge member 204 could be shaped so that the "center" of the "star" is closer to the heel, toe, crown portion, sole portion, etc. of the golf club head body 102. Further, different portions of the multi-legged bridge member 204 can also be varied to affect the center of gravity of the club head body 102. For example, the legs could be: different lengths (e.g., legs on a toe side relative to the "center" of the "star" are longer than legs on a heel side relative to the "center" of the "star"), widened or narrowed, made thicker or thinner, differently tapered (i.e., made relatively wide at one end and comparatively less wide at the other end), symmetrical or asymmetrical (e.g., relative to the "center" of the "star"), etc. in order to achieve the desired center of gravity positioning. Alternatively, or additionally, the "center" of the "star" could be made larger or smaller in diameter, made thicker or thinner, etc.

Further, according to some aspects of this disclosure, the multi-legged bridge member 204 may have a different weight, a different density, a different weight distribution, and/or other different weighting characteristics than the perimeter weighting member 202 (or at least some portions of the perimeter weighting member 202) or other portions of the club head body 102. For example, the multi-legged bridge member 204 may be made heavier as compared to the other parts of the golf club head (e.g., by forming the multi-legged bridge member 204 from a different material than the other parts of the golf club head body 102 or by including a weighted mass, such as lead or tungsten containing material, etc. in the multi-legged bridge member 204). Additionally, different sections or portions of the multi-legged bridge member 204 (e.g., one or more legs, different portions of the same leg, the "center" of the "star", etc.) may have a different weight, a different density, a different weight distribution, and/or other different weighting characteristics (e.g., be made heavier or lighter in a manner such as described above) from each other and/or the perimeter weighting member 202 (or at least some portions of the perimeter weighting member 202) or other portions of the club head body 102. In some arrangements, movement of the weight associated with the club head, i.e., use of the multi-legged bridge member and/or perimeter weighting member may move the center of gravity away from the face of the club in order to provide a higher moment of inertia. This may allow the club head to "turn over" or close more easily.

Yet, according to some other aspects of this disclosure, the multi-legged bridge member 204 may have the same weighting characteristics (weight, density, etc.) as the perimeter weighting member 202 or other portions of the club head body 102. Further, it is noted that, different sections or portions of the perimeter weighting member 202 may also have a different weight, a different density, a different weight distribution, and/or other different weighting characteristics than other sections or portions of the perimeter weighting member 202. For example, the crown portion of the perimeter weighting member 202 may be less dense the sole portion of the perimeter weighting member 202. Regardless of whether the multi-legged bridge member 204 (or a portion thereof) has the same or different weight, density, weight distribution, and/or other weighting characteristics as the perimeter weighting member 202 (or at least portions of the perimeter weighting member 202) or other portions of the club head body 102, the multi-legged bridge member 204 can be still be selectively shaped to control features of the club head's center of gravity 205.

For instance, as mentioned above, FIGS. 2A-C illustrate the different locations of centers of gravity 205 for club heads including some differently shaped multi-legged bridge members 204. In the arrangement shown in FIG. 2A, the shape of the multi-legged bridge member 204 is such that the "center" of the "star" is in the lower heel region of the club head body and, therefore, the legs converge toward the "center" of the "star" in that lower heel region. Hence, the shape of multi-legged bridge member 204 in the depicted embodiment, concentrates mass and weight of the multi-legged bridge member 204 close to the heel. Thus, the center of gravity 205 of this arrangement is closer to the heel of the club head body (e.g., closer to the heel than the toe). In contrast, as shown in FIG. 2C, the shape of the multi-legged bridge member 204 is such that the "center" of the "star" is in the upper toe region of the club head body and, therefore, the legs converge toward the "center" of the "star" in that upper toe region. Hence, the shape of multi-legged bridge member 204 in the depicted embodiment, concentrates mass and weight of the multi-legged bridge member 204 close to the toe. Thus, the center of gravity of this arrangement is closer to the toe of the club head body 102 (e.g., closer to the toe than the heel).

These different locations of the center of gravity 205 of the club head bodies can affect the trajectory and ball flight of a golf ball struck by the golf club. Hence, it is understood that selectively shaping the multi-legged bridge members 204 (e.g., weighted multi-legged bridge members) can produce a set of golf clubs with desirable characteristics. For example, the shape of the multi-legged bridge member in FIG. 2A decreases the distance from the hosel to the center of gravity. Therefore, a "long" iron of such a set of golf clubs has a club head body with a center of gravity near the hosel. Hence, as discussed above, such "long" irons can aid a golfer in imparting a "draw" trajectory to the golf ball and, therefore, provide characteristics of a "draw" shot (i.e., less backspin, further roll and lower ball flight) which will tend to increase the distance that the golf ball will travel upon being struck by the golfer. Conversely, the shape of the multi-legged bridge member in FIG. 2C increases the distance from the hosel to the center of gravity 205. Therefore, a "short" iron of such a set of golf clubs has a club head body with a center of gravity 205 near the toe. Hence, as discussed above, such "short" irons can aid a golfer in imparting "fade" trajectory to the golf ball and, therefore, provide characteristics of a "fade" shot (i.e., more backspin, less roll and higher ball flight) which tend to provide enhanced ball control (e.g., stopping the ball on the green). Additionally or alternatively, the center of gravity positioned toward the rear of the club (i.e., away from the face) may aid in providing higher or more lofted shots, and/or shots having a more right to left trajectory.

As discussed above, the weighting features of golf club heads in accordance with this disclosure are not limited to controlling the horizontal position of the golf club's center of gravity (the horizontal position when the golf club is oriented at a ball addressing position). Rather, the center of gravity in the vertical direction also may be selectively controlled, if desired, in at least some examples of golf club head structures according to this disclosure. Increasing the weight in the crown area of the club head (e.g., by providing more weight in the legs of multi-legged bridge member 204 that are closer to the crown portion), produces a higher center of gravity in the golf club head which can provide a more boring golf ball flight path, e.g., for play in windy conditions, to provide more "running" shots, and/or to help compensate for swing flaws that typically produce an excessively high ballooning flight. Conversely, increasing the weight in the sole area of the club head (e.g., by providing more weight in the legs of the multi-legged bridge member 204 that are closer toward the sole portion), produces a lower center of gravity in the golf club head which can provide a more lofted golf ball flight path, which can help a golfer get the ball in the air.

According to some aspects of this disclosure, the multi-legged bridge member 204 can be shaped so that it extends away from the face of the golf club head body 102. For example, as shown in FIG. 2E the multi-legged bridge member 204 may extend from the heel, toe, sole portion and crown portion of the golf club head body 102 away from the face of the golf club head body 102. FIG. 2F shows a cross-sectional view of such an embodiment wherein the multi-legged bridge member 204 extends from perimeter weighting member 202 (i.e., from the heel, toe, sole portion and crown portion of the golf club head body 102 in the depicted embodiment) away from the face of the golf club head body 102 and does not contact the rear surface of the face of the golf club head body 102. By shaping the multi-legged bridge member 204 to extend away from the face of the golf club head body 102, the center of gravity of the golf club head body 102 can be shifted away from the face of the golf club head body 102. Therefore, the moment of inertia (MOI) of the club head body 102 about its center of gravity is increased. Such an increased MOI can provide more "forgiveness" on "mis-hits" (i.e., shots wherein the golf ball is struck off center of the club head body 102), e.g., by reducing the amount the golf club head body will twist in response to the mis-hit. Another advantage of shaping the multi-legged bridge member 204 to extend away from the face of the golf club head body 102 and, thereby, move more mass and, hence, the center of gravity of the club head body 102 away from the face, is that such a configuration can create a higher ball flight.

As discussed, in such an embodiment wherein the multi-legged bridge member 204 is positioned away from the face of the golf club head body 102, the multi-legged bridge member 204 indicates the center of gravity by the "center" of the "star" or apex of the "star" being positioned at a point in space above the center of gravity of the club head 205. Therefore, when viewed straight on from an angle such as seen in FIGS. 2A-C, the multi-legged bridge member 204 will indicate the center of gravity 205. Of course, according to some other aspects of the disclosure the multi-legged bridge member 204 could be shaped so that it extends straight across the cavity 206 without creating an apex, or the multi-legged bridge member 204 could even be angled toward the rear surface of the club head body 102.

Therefore, it can be seen that selectively shaping the multi-legged bridge member 204 affects the center of gravity of the golf club head. In this way, when the multi-legged bridge member 204 is shaped in a particular fashion, the multi-legged bridge member 204 alters the weight distribution of the golf club head body 102 to move the club head body's center of gravity 205 to a desired position. Additionally, it can be seen that according to aspects of this disclosure, the multi-legged bridge member 204 can both indicate the precise position of the center of gravity of the golf club head body and, also, if desired, be selectively shaped and, if needed, selectively attached to the club head body 102 to shift the weight of the golf club head body 102 in order to move the club head body's center of gravity 205 to a desired position.

Further, it is noted that while the depicted embodiment shown schematically in FIG. 2D demonstrates one progression of the center of gravity location over the course of a set of golf clubs according to one embodiment of this disclosure, this is not to suggest that other progressions or variations are not contemplated within the scope of this disclosure. In fact, other desired progressions or arrangements may be provided without departing from this disclosure. For example, during a club fitting, different multi-legged bridge members 204 could be selectively attached to the club head bodies 102 in a different manner (e.g., from the toe in "long" irons to the heel in "short" irons) to better conform to a particular golfer's swing or tendencies. For example, during a club fitting, in order to analyze a particular golfer's swing, tendencies, characteristics, etc., a club fitter could use a variety of techniques including: observation with the naked eye of either the swing and/or the golfer's body throughout the swing; recording and play back (e.g., in slow motion or real time) of the swing and/or the golfer's body throughout the swing; measurement of particular aspects of the swing including: the angle of the club head and/or the shaft throughout the swing (e.g., at the take away, during the downswing, at impact, during the follow through, etc.), velocity or acceleration of the club head throughout the swing, etc.; computer analysis of the swing, such as computer analysis of the above mentioned measurements and recordings; etc. Upon analyzing the particular golfer's swing or tendencies (e.g., in a manner described above), a club fitter could selectively attach the multi-legged bridge members 204 to the club head bodies 102 based on the analysis of at least one characteristic of a golfer's swing in a manner to better aid a particular golfer achieve a desired result. In some cases, club head bodies may include multi-legged bridge members 204 that are interchangeable as described above. Therefore, the club fitter may exchange or replace the existing interchangeable multi-legged bridge members 204 with other interchangeable multi-legged bridge members 204 in order to better aid a particular golfer achieve a desired result. For example, if a golfer has a tendency to "slice", then the club fitter may employ interchangeable multi-legged bridge members 204 that provide more mass in the heel. Conversely, if a golfer has a tendency to "hook" the golf ball, then the club fitter may employ interchangeable multi-legged bridge members 204 that provide more mass in the toe.

Of course the multi-legged bridge member need not be shaped like a "star" and, instead, other embodiments of the multi-legged bridge member could be employed. In fact, the multi-legged bridge member may take on a wide variety of forms without departing from the spirit of disclosure. For example, according to some aspects of this disclosure, instead of a "star" shape, a "spider" or "windmill" shaped multi-legged bridge member could be used.

Figure 3A:
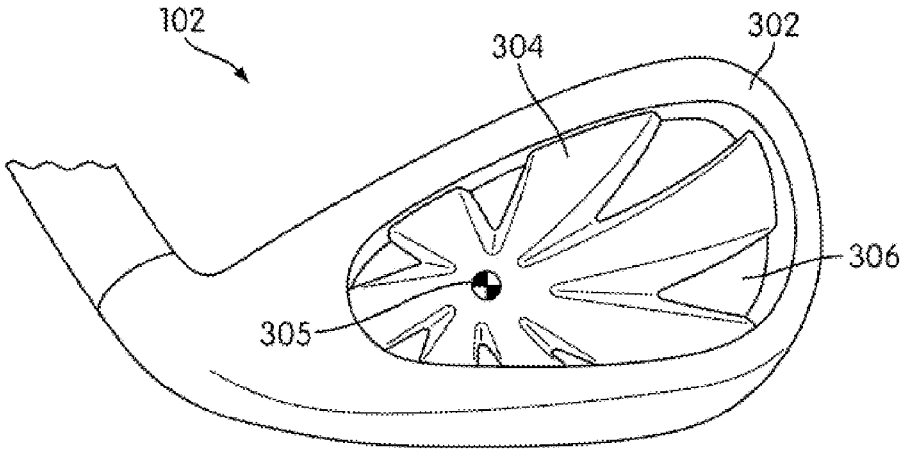
FIGS. 3A-3C illustrate golf club head structures according to at least some examples of this disclosure.
Figure 3B:
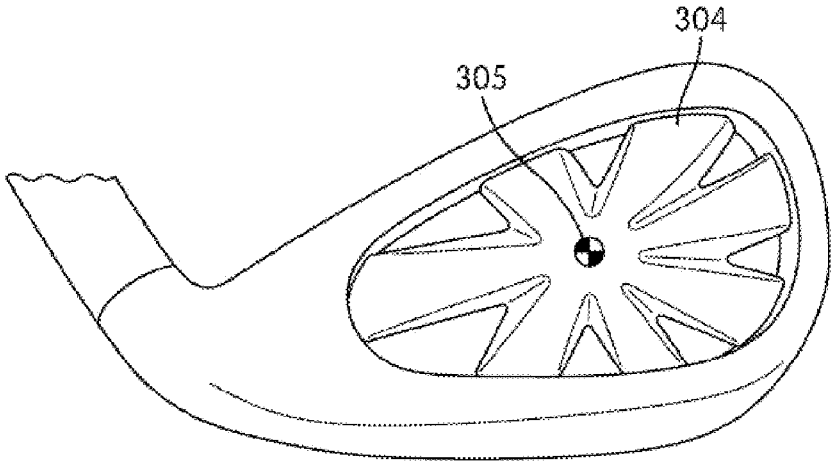
Figure 3C:
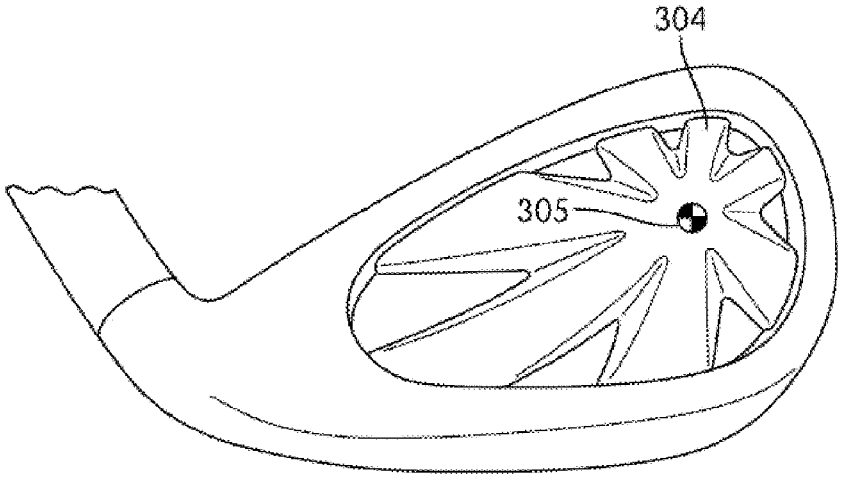

FIGS. 3A-C illustrate such example structures that may be included in golf clubs and golf club head bodies in accordance with this disclosure. As seen in FIGS. 3A-C, each golf club head body 102 includes a perimeter weighting member 302 (similar to the perimeter weighting member described above) and a multi-legged bridge member indicator 304. The embodiment shown in FIGS. 3A-C is similar to the embodiment described above and, therefore, for the sake of brevity will not be repeated here. However, it is noted that at least one of the legs of the multi-legged bridge member indicator 304 exhibits a curved shape which resembles a "spider leg" or a "windmill blade." According to some aspects of this disclosure, the curvature of the legs may be uniform throughout the multi-legged bridge member 304 or, alternatively, some or all of the legs could have varying degrees of curvature.

Further, as discussed above in regard to the previously described embodiment, according to some aspects of this disclosure, in a set of golf clubs wherein each golf club head body has a different center of gravity location, the multi-legged bridge member 304 for each golf club head body 102 may be different (e.g., a differently shaped element) in order to reflect the different location of the center of gravity of each particular golf club head body in the set. FIGS. 3A-C illustrate golf club head bodies of such a set of golf clubs. FIG. 3A is an illustrative embodiment of a golf club head body 102 for a "long" iron (e.g., a 3-iron), FIG. 3B is an illustrative embodiment of a golf club head body 102 for a "middle" iron (e.g., a 5-iron), and FIG. 3C is an illustrative embodiment of a golf club head body 102 for a "short" iron (e.g., a 9-iron). As can be seen by comparing FIGS. 3A, 3B and 3C, the different golf club head bodies each have a different center of gravity 305 and, further, the multi-legged bridge members 304 are shaped to reflect the respective centers of gravity 305 for the different golf club head bodies.

As seen by comparing FIGS. 3A, 3B and 3C, according to the depicted embodiment, the progression of center of gravity location 305 of the club head body 102 moves generally successively from the lower heel in "long" irons to the upper toe in "short" irons. In this way, the apex or the "center" of the "spider"/"windmill" shape of the multi-legged bridge member 304 of each golf club head body 102 reflects the different center of gravity for each particular golf club head body 102. However, as mentioned above with regard to the previously described embodiment, this is merely one embodiment of the disclosure and other desired progressions of the multi-legged bridge members 304 may be provided without departing from this disclosure (e.g., the multi-legged bridge members 304 could shift in an opposite direction (i.e., from the toe end in "long" irons to the heel end in "short" irons)). Therefore, it is realized that the multi-legged bridge members 304 may be positioned or arranged in or around the golf club head bodies of a set of golf clubs in a variety of different manners, orientations, and the like without departing from this disclosure.

Further, as discussed above in regard to the previously described embodiment, according to some aspects of this disclosure, in addition to merely indicating the location of the center of gravity of the club head body 102, the shape of the multi-legged bridge member 304 can be used to alter (e.g., shift) the center of the gravity of the club head body 102. For example, due to weighting characteristics (weight, density, etc.) of the multi-legged bridge member 304, the shape of the multi-legged bridge member 304 will redistribute the weight of the golf club head body 102 (as compared to the golf club head body without the multi-legged bridge member indicator 304) and thereby shift the club head body's center of gravity 305. Therefore, the multi-legged bridge member 304 can be selectively shaped to control features of the club head's center of gravity 305.

While the above described embodiments relate to sets of the golf clubs wherein the multi-legged bridge members are generally of the same type (e.g., "star-shaped", "spider-shaped", etc.), this is not to suggest that the same types of multi-legged bridge members must be used within the same set. In other words, the multi-legged bridge members used throughout the set do not necessarily have to be uniform in the type. In fact, according to some aspects of this disclosure, different types of multi-legged bridge members are used within the same set.

Figure 4A:
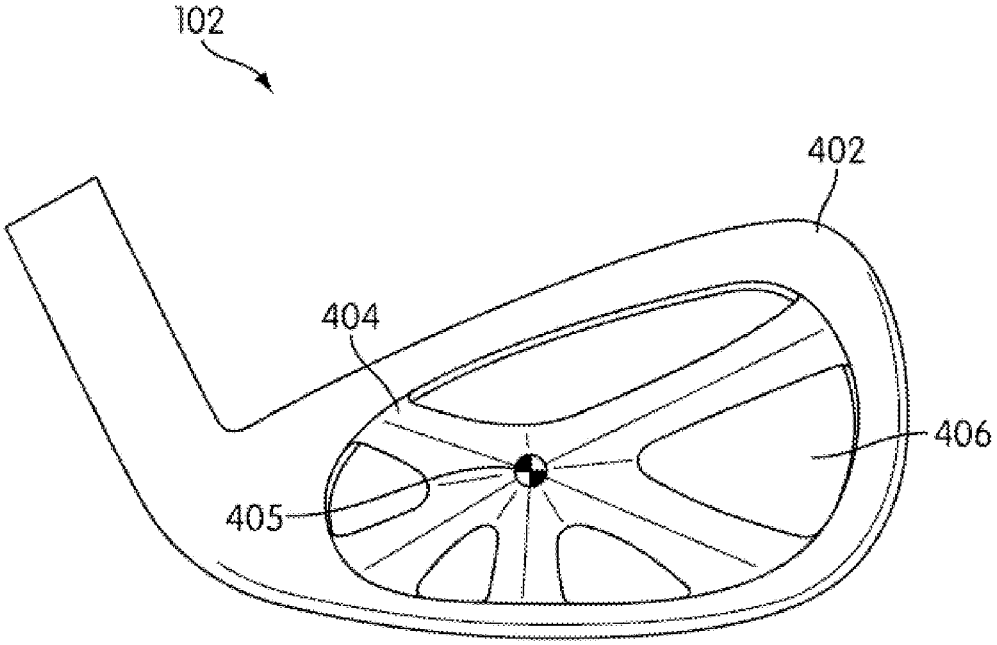
FIGS. 4A and 4B illustrate golf club head structures according to at least some examples of this disclosure.
Figure 4B:
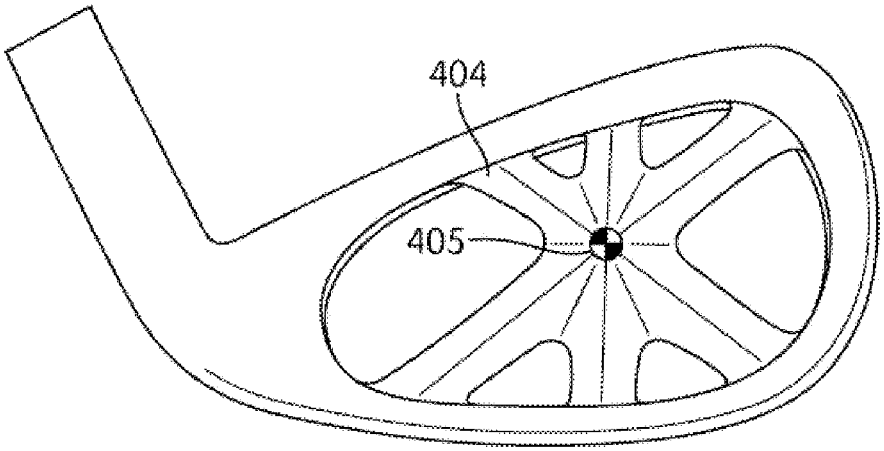

FIGS. 4A and 4B illustrate such example structures of multi-legged bridge members 404 that may be included in the golf club head bodies 102 of a set of golf clubs in accordance with this disclosure. The embodiments shown in FIGS. 4A and 4B are embodiments similar in most respects to the embodiments described above and, therefore, for the sake of brevity will not be repeated here. However, in contrast to the above described embodiments, in a set of golf clubs according to this illustrative embodiment, the number of points of contact that the multi-legged bridge member 404 has with the golf club head body 102 varies in regard to the particular club head body.

For example, FIG. 4A is an illustrative embodiment of a golf club head body 102 for a "long" iron (e.g., a 3-iron) and FIG. 4B is an illustrative embodiment of a golf club head body 102 for a "short" iron (e.g., a 9-iron). As can be seen by comparing FIGS. 4A and 4B, the multi-legged bridge member 404 shown in the long iron, FIG. 4A, has five points of the contact with the golf club head body 102, while the multi-legged bridge member shown in the short iron, FIG. 4B, has six points of contact with the golf club head body 102. Such a change in the points of the contact with the golf club head body allows a user to quickly distinguish between different types of clubs (e.g., five legs in "long" irons as opposed to six legs in "short" irons). Further, according to aspects of this disclosure, the same concept is used to distinguish between individual club head bodies rather than different types of club head bodies. In other words, each individual club head body could have a different number of points of contact than the other club head bodies in the set. Similarly, other differences between types of club head bodies or individual club head bodies could be used also. For example, the "star" shape of the multi-legged bridge member 204 could be used for "long" irons, while the "spider" shape of the multi-legged bridge member 304 could be used for "short" irons.

Further, as discussed above in regard to the previously described illustrative embodiments, according to some aspects of this disclosure, in a set of golf clubs wherein each golf club head body has a different center of gravity location, the multi-legged bridge member 404 for each golf club head body 102 may be different (e.g., a differently shaped element) in order to reflect the different location of the center of gravity of each particular golf club head body in the set. As can be seen by comparing FIGS. 4A and 4B, the different golf club head bodies 102 each have a different center of gravity 405 and, further, the multi-legged bridge members 404 are positioned to reflect the respective centers of gravity 405 for the different golf club head bodies 102. As seen by comparing FIGS. 4A and 4B, according to the depicted embodiment, the progression of the center of gravity 405 of the club head body 102 moves generally successively from the lower heel in "long" irons to the upper toe in "short" irons. However, as mentioned above with regard to the previously described illustrative embodiments, this is merely one illustrative embodiment of the disclosure and other desired progressions of the multi-legged bridge member 404 may be provided without departing from this disclosure. Therefore, it is realized that the multi-legged bridge members 404 may be positioned or arranged in or around the golf club head bodies of a set of golf clubs in a variety of different manners, orientations, and the like without departing from this disclosure. Further, it is realized that in a set of golf clubs according to example embodiments of this disclosure, in addition to differentiating between different types of the club head bodies 102, the multi-legged bridge members 404 also indicate the precise position of the center of gravity of each particular golf club head body in the set.

Further, as discussed above in regard to the previously described embodiments, according to some aspects of this disclosure, in addition to merely indicating the location of the center of gravity 405 of the club head body 102, the shape of the multi-legged bridge member 404 can be used to alter (e.g., shift) the center of the gravity of the club head body 102. For example, due to weighting characteristics (weight, density, etc.) of the multi-legged bridge member indicator 404, the shape of the multi-legged bridge member 404 will redistribute the weight of the golf club head body 102 (as compared to the golf club head body without the multi-legged bridge member 404) and thereby shift the center of gravity 405 of the club head body 102. Therefore, the multi-legged bridge member indicator 404 can be selectively shaped to control features of the center of gravity 405 of the club head body 102. Hence, in a set of golf clubs according to an illustrative embodiment of this disclosure, in addition to both differentiating between different types of the club head bodies, and indicating the precise position of the center of gravity of each particular golf club head body in the set, the multi-legged bridge members 404 can also, if desired, be selectively shaped to shift the weight of the golf club head body 102 in order to move the club head body's center of gravity 405 to a desired position.

Any type of iron type golf club head structure may include multi-legged bridge member of the types described above (e.g., 204, 304, 404, etc.), including, for example: iron type hybrid clubs, driving irons, 0-10 irons, wedges (e.g., iron type clubs having lofts from 44-68 degrees, such as pitching wedges, lob wedges, sand wedges, gap wedges, etc.), chipping clubs, etc. If desired, in accordance with at least some examples of this disclosure, golf clubs and/or golf club heads in accordance with examples of this disclosure may be sold or marketed as a set including plural irons, including, for example, sets having two or more of iron type hybrid clubs, driving irons, 0-10 irons, pitching wedges, lob wedges, sand wedges, gap wedges, and/or chipping clubs. When present in a set, any desired number of the clubs in the set may have a club head with a multi-legged bridge member in accordance with this disclosure. In some more specific examples, sets of golf clubs in accordance with this disclosure may contain at least the 3-9 irons and a pitching wedge, wherein at least 2 of these irons (and in some examples, all of these irons) will have a club head with a multi-legged bridge member in accordance with examples of this disclosure. As another example, sets of golf clubs in accordance with this disclosure will contain at least the 4-9 irons (or even 5-9 irons or 6-9 irons) and a pitching wedge, and optionally a sand wedge and/or one or more iron type hybrid clubs, wherein at least 2 of these clubs (and in some examples, all of these clubs) will have a club head with a multi-legged bridge member in accordance with examples of this disclosure.

Iron type golf club heads including multi-legged bridge members in accordance with examples of this disclosure are not limited for use with perimeter weighted and/or cavity back type clubs of the types illustrated in FIGS. 1-4. Rather, if desired, multi-legged bridge members may be provided (e.g., in similar positions and/or arrangements) in blade type iron clubs or other iron type golf club head structures without departing from this disclosure. Rather than forming a portion of a perimeter weight member, in blade type clubs, the multi-legged bridge members may be located in at least one of the upper rear portion of the back side of the club, the lower rear portion of the rear portion of the back side of the club, the club sole, etc.

Further, it is noted that while the multi-legged bridge member indicators have been discussed above as indicating the center of gravity of a golf club head body, the multi-legged bridge member indicators could indicate other features of the golf club head (e.g., "sweet spot", etc.) as well.

Finally, it is noted that the specific multi-legged bridge members discussed in detail above are merely examples of multi-legged bridge members that may be used in accordance with this disclosure and are not meant to constitute an exhaustive list. On the contrary, these illustrative examples are simply intended to provide the reader with a better understanding of the disclosure.

For example, according to some aspects of this disclosure, the multi-legged bridge member includes an opening at the "center" or apex of the multi-legged bridge member. The opening at the "center" or apex indicates the club head body's center of gravity. According to some aspects of this disclosure, the rear surface (e.g., the back of face of the golf club head body 102) may exhibit a color in order to help golfer more easily see the center of gravity via the color through the opening. For example, the back of face of the golf club head body 102 may be painted a bright color (e.g., red, yellow, orange, etc.). Alternatively, a colored dot on the apex or "center" could be used to more readily indicate the center of gravity of the club head body. Further, according to other aspects of this disclosure, the multi-legged bridge member may be formed from several pieces rather than a single unit. Overall, it is understood that while there are many ways in which the multi-legged bridge member could be formed to indicate the respective location of the club head body's center of gravity, as long as the multi-legged bridge member reflects the location center of gravity of a particular golf club head body, it is considered within the scope of the disclosure.

Additional example golf club and golf club head structures in accordance with this invention may relate to "wood-type" golf clubs and golf club heads, e.g., clubs and club heads typically used for drivers and fairway woods, as well as for "wood-type" utility or hybrid clubs, or the like. Although these club head structures may have little or no actual "wood" material, they still may be referred to conventionally in the art as "woods" (e.g., "metal woods," "fairway woods," etc.). The wood-type golf club heads described herein may include a multiple piece construction and structure, e.g., including one or more of a sole member, a face member (optionally including a ball striking face integrally formed therein or attached thereto), one or more body members (e.g., material extending around the perimeter and making up the club head body), a crown member, a face plate, a face frame member (to which a ball striking face may be attached), an aft body, etc. Of course, if desired, various portions of the club head structure may be integrally formed with one another, as a unitary, one piece construction, without departing from the invention (e.g., the body member(s) may be integrally formed with the sole and/or crown members, the face member may be integrally formed with the sole, body, and/or crown members, etc.). Optionally, if desired, the various portions of the wood-type golf club head structure (such as the sole member, the crown member, the face member, the body member(s), etc.) individually may be formed from multiple pieces of material without departing from this invention (e.g., a multi-piece crown, a multi-piece sole, etc.). Also, as other alternatives, if desired, the entire wood-type golf club head may be made as a single, one piece, unitary construction, or a face plate member may be attached to a one piece club head aft body (optionally, a hollow body, etc.). More specific examples and features of wood-type golf club heads and golf club structures according to this invention will be described in detail below in conjunction with the example wood-type golf club structures illustrated in FIGS. 5A through 9.

Figure 5A:
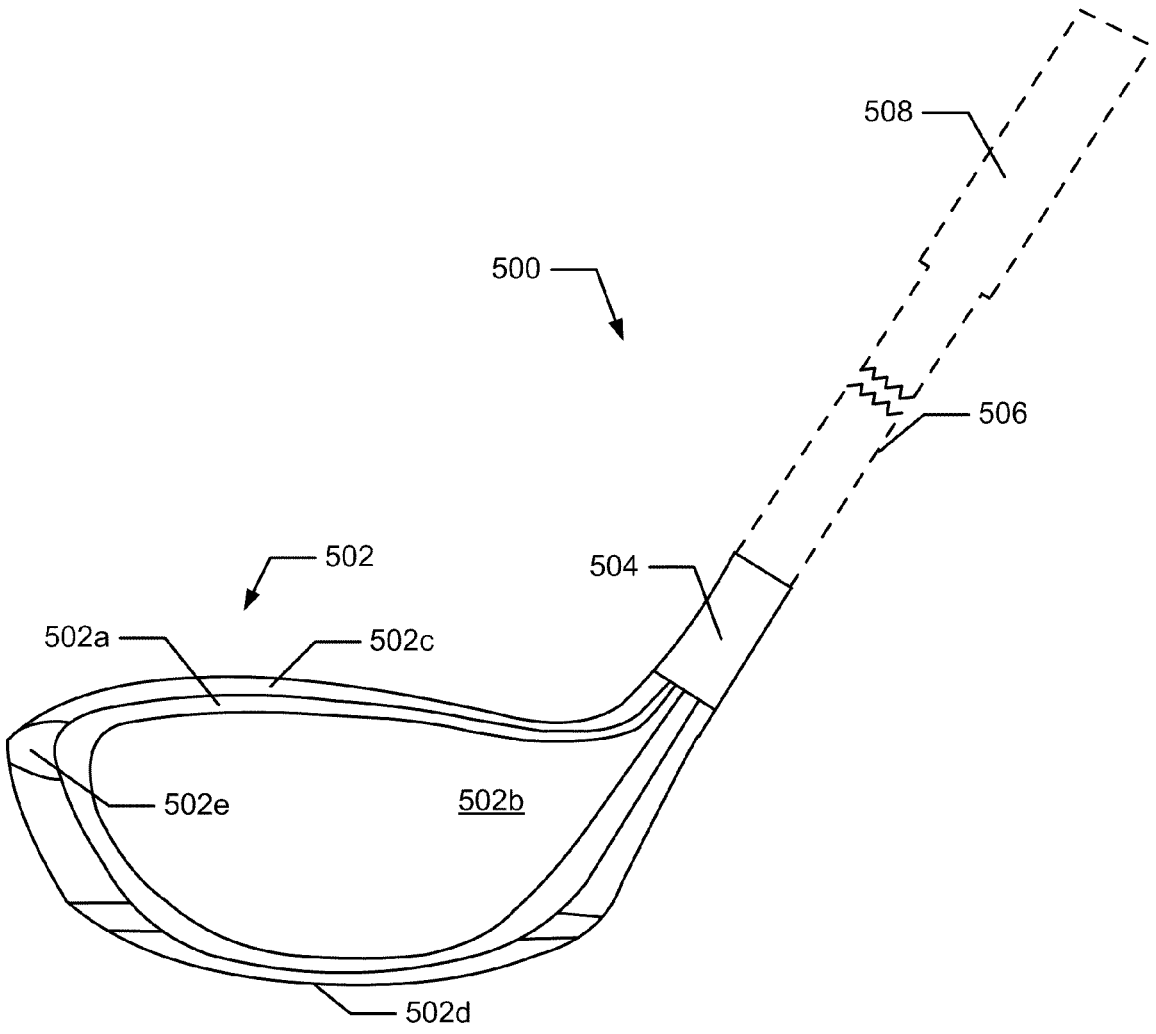
FIGS. 5A and 5B illustrate an example wood-type golf club head according to at least some examples of this disclosure.
Figure 5B:
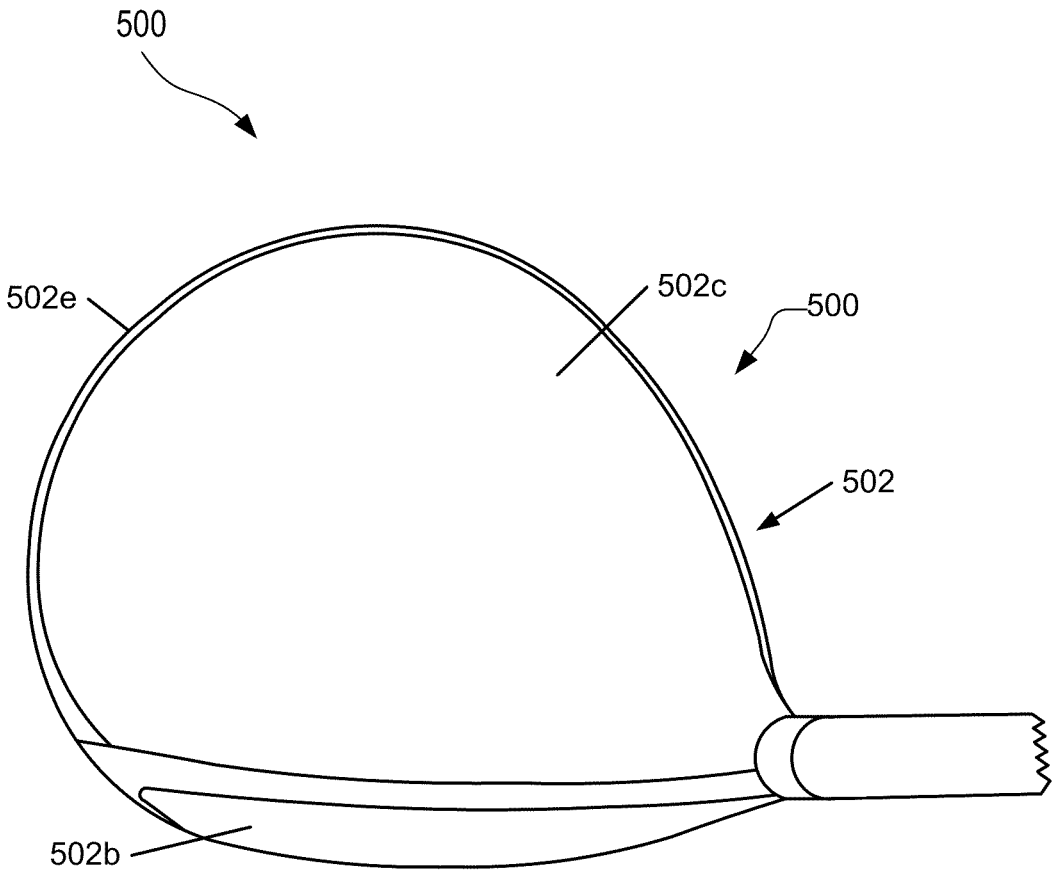

FIGS. 5A and 5B generally illustrate a wood-type golf club 500 that may be used in accordance with one example of this invention. The golf club 500 includes a golf club head 502 having, in the arrangement shown, a multi-part construction and a hosel area 504 at which the head 502 is connected to a shaft 506. Similar to the arrangements described above, the hosel area 504 may be of any desired design and construction without departing from this invention (e.g., an exteriorly extending hosel member 504, as shown; an internal hosel member; a releasable hosel member; etc.), including conventional designs and constructions as are known and used in the art. Likewise, the shaft 506 may be made of any desired materials and connected to the hosel area 504 (or directly to the club head 502) in any desired manner, including conventional materials, connected in conventional manners, as are known and used in the art. As some more specific examples, if desired, the shaft 506 may be made from steel (including stainless steel), aluminum, or other metal or metal alloy materials; graphite based materials; composite or other non-metal materials; polymeric materials, combinations of various materials, etc. As described above, the shaft 506 may be connected to the hosel area 504 and/or directly to the club head 502 via cements or adhesives, via mechanical connection systems, and the like. If desired, the shaft 506 may be connected to the hosel area 504 or to the club head 502 by a releasable mechanical or adhesive connection that easily allows the club head 502 and shaft 506 to be separated from one another (and optionally thereafter engaged with a different head or shaft).

Similar to the above-described arrangements, a grip member 508 or other handle element may be provided on and/or integrally formed with the shaft 506. Any desired materials may be used for the grip member 508, such as rubber based materials (synthetic or natural); polymer based materials (including cord or other fabric or textile containing polymers); leather materials (synthetic or natural); etc. The grip member 508 or other handle element may be engaged with or formed as part of the shaft 506 in any desired manner without departing from this invention, including through the use of adhesives or cements, mechanical connectors (e.g., threaded connections), welding, soldering or the like. In some arrangements, the grip or handle member 508 may be integrally formed as a unitary, one-piece construction with the shaft member 506. In at least some example structures according to this invention, the grip member 508 will be made of conventional materials as are known and used in the art, and it will be attached to the shaft member 506 in conventional manners as are known and used in the art.

The wood-type golf club head 502 itself also may be constructed in any suitable or desired manner and/or from any suitable or desired materials without departing from this invention, including from conventional materials and/or in conventional manners known and used in the art. For example, in the example structure 502 shown in FIGS. 5A and 5B, the club head 502 includes a ball striking face member 502*a* (optionally including a ball striking face plate 502*b* integrally formed with the face member 502*a* or attached to club such that the face plate 502*b* and a frame member together constitute the overall face member 502*a*). In some arrangements, the ball striking face member 502*a* and/or ball striking face plate 502*b* may be connected to the remainder of the club head using one or more mechanical fasteners. The club head 502 of this illustrated example further includes a crown 502*c*, a sole 502*d*, and at least one body portion 502*e* located between the crown or top portion 502*c* and the sole 502*d* (e.g., material extending from the face member 502*a*, around the club head periphery from the heel to the toe). This body portion 502*e*, which extends to a location substantially opposite the striking face, may include a rear portion of the club head structure.

A wide variety of overall wood-type golf club head constructions are possible without departing from this invention. For example, if desired, some or all of the various individual parts of the club head 502 described above may be made from multiple pieces that are connected together (e.g., by welding, adhesives, or other fusing techniques; by mechanical connectors; etc.). The various parts (e.g., crown 502*c*, sole 502*d*, and/or body portion(s) 502*e*) may be made from any desired materials and combinations of different materials, including materials that are conventionally known and used in the art, such as metal materials, including lightweight metal materials. More specific examples of suitable lightweight metal materials include steel, titanium and titanium alloys, aluminum and aluminum alloys, magnesium and magnesium alloys, etc.

As additional examples or alternatives, in order to reduce the club head 502 weight, if desired, one or more portions of the club head structure 502 advantageously may be made from a composite material, such as from carbon fiber composite materials that are conventionally known and used in the art. Other suitable composite or other non-metal materials that may be used for one or more portions of the club head structure 502 include, for example: fiberglass composite materials, basalt fiber composite materials, polymer materials, etc. As some more specific examples, if desired, at least some portion(s) of the crown member 502*c* may be made from composite or other non-metal materials. Additionally or alternatively, if desired, at least some portion(s) of the sole member 502*d* may be made from composite or other non-metal materials. As still additional examples or alternatives, if desired, one or more portions of the club head's body member 502*e* (e.g., U-shaped or C-shaped ribbons of material that extend around the rear of the club head 502 and from the face component's 502*b* heel edge to the toe edge) may be made from composite or other non-metal materials. As yet further examples, if desired, the entire body portion of the club head aft of a club head face member 502*a* (also called an "aft body"), or optionally the entire club head, may be made from composite or other non-metal materials without departing from this invention. The composite or other non-metal material(s) may be incorporated as part of the club head structure 502 in any desired manner, including in conventional manners that are known and used in the art. Reducing the club head's weight (e.g., through the use of composite or other non-metal materials, lightweight metals, metallic foam or other cellular structured materials, etc.) allows club designers and/or club fitters to selectively position additional weight in the overall club head structure 502, e.g., to desirable locations to increase the moment of inertia, affect the center of gravity location, and/or affect other playability characteristics of the club head structure 502 (e.g., to draw or fade bias a club head; to help get shots airborne by providing a low center of gravity; to help produce a lower, more boring ball flight; to help correct or compensate for swing flaws that produce undesired ball flights, such as hooks or slices, ballooning shots, etc.), as will be discussed more fully below.

The various individual parts that make up a club head structure 502, if made from multiple pieces, may be engaged with one another and/or held together in any suitable or desired manner, including in conventional manners known and used in the art. For example, the various parts of the club head structure 502, such as the face member 502*a*, the ball striking plate 502*b*, the crown 502*c*, the sole 502*d*, and/or the body portion(s) 502*e* may be joined and/or fixed together (directly or indirectly through intermediate members) by adhesives, cements, welding, soldering, or other bonding or finishing techniques, and the like. In some arrangements, the various parts of the club head 502 may be joined by mechanical connectors (such as threads, screws, nuts, bolts, or other connectors), and the like. If desired, the mating edges of various parts of the club head structure 502 (e.g., the edges where members 502*a*, 502*b*, 502*c*, 502*d*, and/or 502*e* contact and join to one another) may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 502 together.

The dimensions and/or other characteristics of a wood-type golf club head structure according to examples of this invention may vary significantly without departing from the invention. As some more specific examples, club heads in accordance with at least some examples of this invention may have dimensions and/or other characteristics that fall within the various example ranges of dimensions and/or characteristics of the club heads described in U.S. patent application Ser. No. 11/125,327 filed May 10, 2005 (and corresponding to U.S. Published Patent Appln. No. 2005-0239576 A1 published Oct. 27, 2005). Note, for example, the Tables in these documents. This U.S. patent publication is entirely incorporated herein by reference. In accordance with at least some example club head structures according to this invention, the ratio of the breadth dimension (i.e., overall dimension "B" in the front to back direction) to length dimension (i.e., overall dimension "L" from in the heel to toe direction) (i.e., ratio "B/L") will be at least 0.9, and in some examples, this ratio may be at least 0.92, at least 0.93, at least 0.94, at least 0.95, at least 0.96, at least 0.97, or even at least 0.98. The length dimension L may be at least 4 inches, and in some examples, at least 4.25 inches, at least 4.5 inches, at least 4.75 inches, or even at least 4.85 inches. The club head may have any desired volume, including, for example, a volume of at least 200 cc, and in some examples at least 350 cc, at least 400 cc, at least 420 cc, or even at least 450 cc.

Figure 6A:
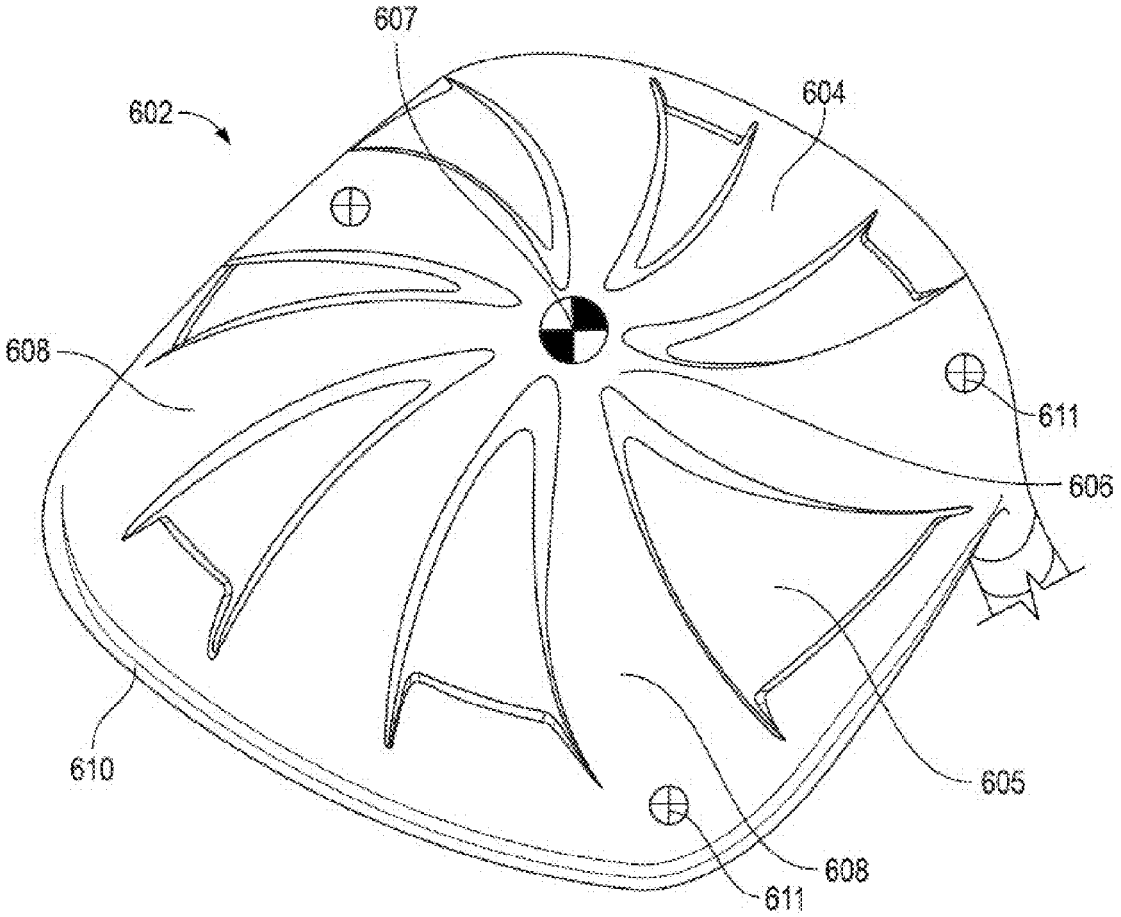
FIGS. 6A and 6B illustrate one example wood-type golf club head structure including an indicator providing a visual indication of the location of the center of gravity of the golf club head according to at least some examples of this disclosure.
Figure 6B:
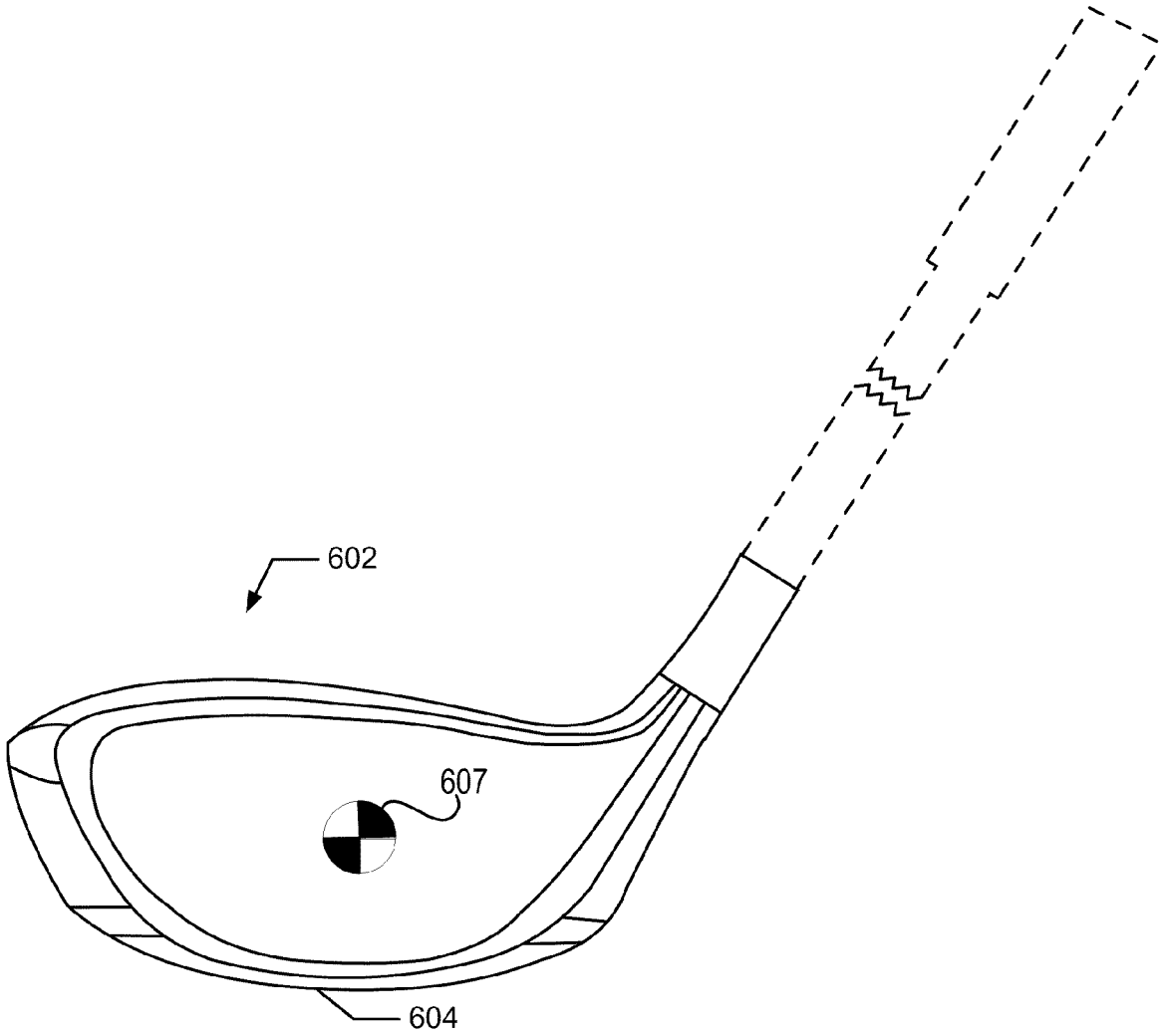

FIGS. 6A and 6B illustrate one example wood-type golf club head 602 arrangement including an indicator 604 to identify a location of a center of gravity (denoted symbolically at reference numeral 607) of the golf club head 602. The indicator 604 may be arranged on, or integrally provided as, a bottom surface or sole 605 of the golf club head 602 and includes a central region or hub 606 generally positioned above the center of gravity 607 of the golf club head 602. In some arrangements, the indicator 604 may be formed separately from the remainder of the club head 602 and connected to the club head 602 using known means of attachment, including cements, adhesives, welding, soldering, mechanical connectors (e.g., threaded fasteners, snap fits, etc.), and the like. In some arrangements, the indicator 604 may be releasably engaged with the club head 602 in order to allow for the interchange of one indicator with another indicator, as will be discussed more fully below.

Although the indicator will generally be described as being formed on a bottom surface or sole 605 of the golf club head, the indicator may also be formed on a top surface or crown of the golf club head and may be formed of more lightweight materials to aid in maintaining a center of gravity low within the golf club head. Also, an indicator formed in the crown of the golf club head may generally serve as an indicator of the location of the center of gravity rather than providing weight distribution to move or adjust the center of gravity.

In other examples, the indicator 604 may be integrally formed with the club head 602, for instance, in a mold or as part of a casting, forging, or machining operation. In some wood-type golf club heads 602 including an indicator 604 as described herein, the indicator 604 may form at least a portion of the bottom surface or sole 605 of the golf club head 602. For instance, in some examples, the indicator 604 may extend across substantially all of the bottom surface 605 of the club head 602. That is, the indicator 604 may extend along the sole 605 of the club head 602 from a location at or proximate to the ball striking face to a location at or proximate to the rear edge of the club head and from a location at or proximate to a toe edge of the club head to a location at or proximate to a heel edge of the club head. The location being proximate to an edge or region of the golf club head may, in some arrangements, indicate that the location is within 0.75 inches of the outermost edge or surface of the edge or region. In other arrangements, proximate may indicate that the location is within 10% of the overall front to back (or side to side) dimension of the club head of the outermost edge or surface of the edge or region. In other arrangements, the indicator 604 may extend across substantially all of the bottom surface 605 of the club head 602 if the indicator extends across at least 75-85% of the bottom surface 605 of the golf club head.

The indicator 604 shown further includes a plurality of legs 608 extending outward from the central region or hub 606 to an outer perimeter 610 of the golf club head 602. In the arrangement of FIG. 6A, the indicator 604 includes seven legs 608 extending outward from the hub 606. The legs 608 shown may be evenly spaced, may be symmetrical about one or more axis of the club head 602, may be asymmetrical, etc. This number of legs and leg arrangements shown in the figures are merely example arrangements and more or fewer legs 608, or other, alternative leg configurations may be used without departing from the invention.

Similar to the arrangements described above, the central region or hub 606 may be generally aligned with the center of gravity 607 of the golf club head 602 to provide a visual indicator of the location of the center of gravity 607 of the golf club head 602 when the golf club head is oriented at its design lie angle and at a ball address orientation. Center of gravity 607 merely indicates a horizontal location of the center of gravity 607 and does not indicate a vertical location of the center of gravity. In some arrangements, the indicator 604 may be positioned vertically below the center of gravity 607 of the golf club head when the sole 605 of the club head 602 is oriented at its design lie angle in a ball address orientation (e.g., with the sole 605 in contact with a ground surface). Stated differently, the hub 606 would be directly over the center of gravity 607 of the golf club head 602 when the sole 605 is viewed from above. For instance, when looking at golf clubs in a golf bag to select a club, the indicator 604 provides a visual indication of the location of the center of gravity 607 for that particular club. Additionally or alternatively, during a club fitting, a club fitter may select a golf club based on the location of the center of gravity. This visual indicator 604 allows the fitter to quickly and easily identify the location of the center of gravity 607 for each club. Although the hub 606 may, in some examples, be located precisely or directly over a center of gravity, in other examples, the hub 606 may be used to generally indicate a location of the center of gravity. For instance, conventional golf clubs generally have a center of gravity in the center of the golf club head. The position of the hub 606 as described herein may adjust that center of gravity and/or provide a general indication of the location of the center of gravity.

In some arrangements, the hub 606 and extending legs 608 may be formed to redistribute a portion of the weight associated with the club head 602 in order to adjust or move the center of gravity 607 of a golf club head 602. For instance, the indicator 604, including the central region or hub 606 and extending legs 608, may, in part or in whole, be formed of a material heavier or more dense than the material making up at least a majority of the remainder of the golf club head 602 in order to lower the center of gravity 607 of the golf club head 602 to aid in providing more loft for a ball. For instance, the indicator 604 may include or be formed of steel, such as carbon steel, stainless steel, etc., tungsten, copper, and the like in order to provide more weight in the sole portion 605 of the club head 602, thereby lowering the center of gravity of the golf club head 602. In some arrangements, the central portion 606 may be formed of the heavier material while the legs 608 extending outward may be formed of a lighter, less dense material, such as ceramic, aluminum, aluminum alloys, titanium, titanium alloys, magnesium alloys, polymers, composite material, and the like. In still other arrangements, the legs 608 may be weighted such that the portion proximal the perimeter 610 of the club head 602 is heavier than the portion proximal the central region 606 of the indicator 604, e.g., to increase the club head's perimeter weighting and/or moment of inertia characteristics. In still other arrangements, some leg members 608 may be formed of heavier materials than other leg members 608. For instance, leg members 608 extending toward the rear of the club head may be formed of heavier materials in order to distribute more weight associated with the club head to the rear of the club head, which may aid in providing a more lofted ball launch.

In still other arrangements, the indicator 604 or portions thereof may have varying thickness. For instance, the hub region 606 may be thicker than the legs 608 in order to concentrate more weight associated with the indicator 604 at or near the center of gravity 607 of the club head 602. In another example, the legs 608 may be thicker at an end proximal the hub 606 than at an end proximal the perimeter 610 of the club to focus more weight at or near the center of gravity 607 of the club head 602. In still other examples, the legs 608 may be thicker near a perimeter 610 of the club head 602 to provide additional weight to an outer region of the club head 602. The legs 608 and hub 606 may also have thicknesses that vary within the hub 606 or legs 608. That is, the thickness of one or more legs 608 may change multiple times depending on the position along the leg 608, location of the leg 608, etc.

As shown in FIG. 6A, the legs 608 extending outward from the central region or hub 606 generally curve as they extend outward, toward the perimeter 610 of the golf club head 602. Additionally or alternatively, some or all of the legs 608 may be straight and extend linearly from the hub 606 to the perimeter 610 of the golf club head 602. Further, the legs 608 may taper as they become more proximal to the central region or hub 606 of the indicator 604. That is, the legs 608 may, in some examples, be wider at an end more proximal the perimeter 610 of the club head 602 than the end more proximal the central region or hub 606. This taper may aid in distributing a greater portion of the weight associated with the legs 608 to an outer region of the golf club head 602, more proximal the perimeter 610 of the golf club head 602, in order to provide improved performance of the golf club.

In addition, the arrangement of the indicator 604 as shown and described may aid in reducing the overall weight associated with the club head 602. For instance, conventional club heads may have a sole formed of a solid piece of material. The indicator 604 arrangement described herein includes a central region or hub 606 and a plurality of legs 608 extending outward therefrom. However, as shown in the example structure of this figure, the regions between the extending legs 608 may constitute open space. Thus, the overall amount of material associated with the sole is less than a conventional solid sole and the weight associated with the club head 602 overall is also reduced by decreasing the amount of material used. If desired, a thin plate may be provided on the inside surfaces between the legs 608 to prevent the club head structure 602 from having openings therethrough.

FIG. 6B illustrates one example position of a center of gravity 607 that may be indicated by the indicator 604 shown in FIG. 6A. For instance, the indicator 604 shown in FIG. 6A is positioned generally in a center of the golf club head 602. The indicator 604 provides a visual indication from the club head bottom that the center of gravity 607 is positioned generally in the center of the golf club head 602. FIG. 6B illustrates one example centrally located center of gravity 607. The center of gravity 607 may be vertically higher or lower (i.e., more proximal the top surface or crown, or bottom surface or sole), however the center of gravity 607 is generally in a center of the club head 602, as shown by the hub portion 606 of the indicator 604 in FIG. 6A.

Figure 7A:
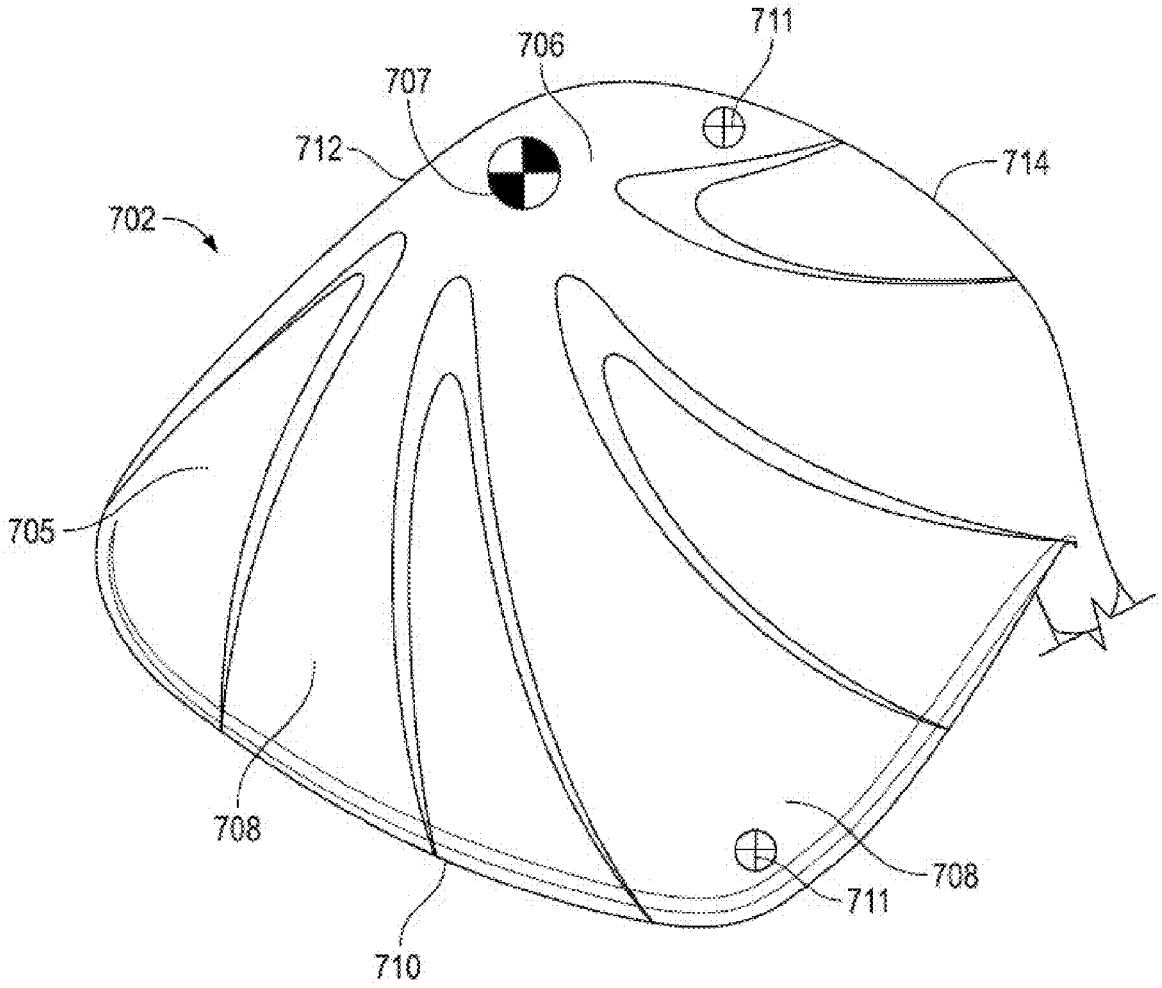
FIGS. 7A and 7B illustrate another example wood-type golf club head structure including an indicator providing a visual indication of the location of the center of gravity of the golf club head according to at least some examples of this disclosure.
Figure 7B:
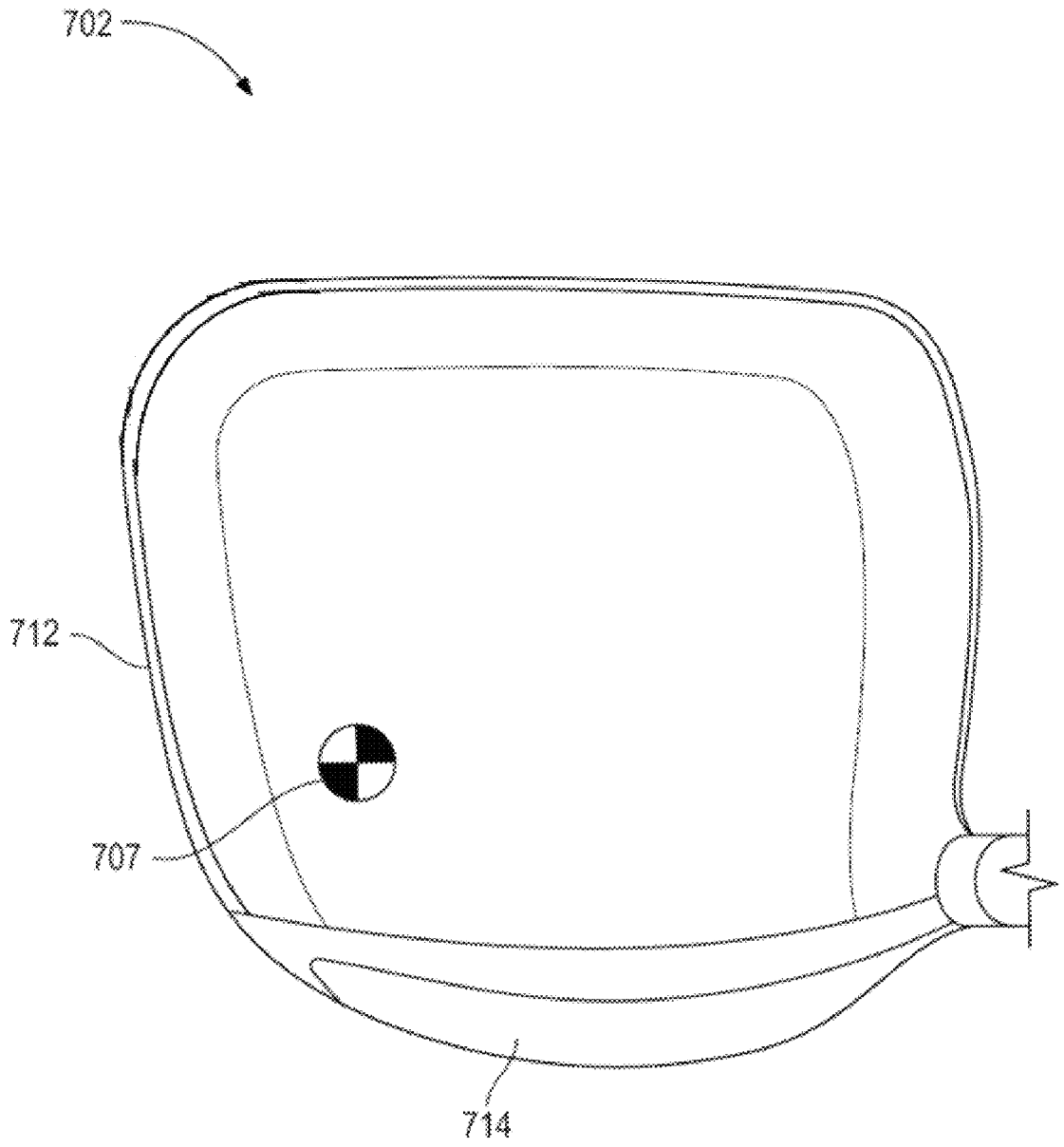

FIGS. 7A and 7B illustrate another example wood-type golf club head 702 having an indicator 704 formed in a sole portion 705 of the golf club head 702. Similar to the arrangement shown in FIG. 6A, the indicator 704 includes a central region or hub 706, as well as a plurality of legs 708 extending outward from the hub 706 toward a perimeter 710 of the golf club head 702. However, the shape of the indicator 704 is different from indicator 604 to indicate the different center of gravity location. The indicator 704 shown on the golf club head 702 of FIG. 7 may be generally vertically aligned with the center of gravity 707 of the golf club head 702 when the club head is oriented at its design lie angle at a ball address orientation. In various arrangements described throughout this application, the hub may be considered "generally aligned" or "generally vertically aligned" with the center of gravity when a vertical line running through the center of gravity is located within one inch (1") of a center location of the hub. The golf club head 702 of FIG. 7 generally has a center of gravity 707 positioned near a toe region or edge 712 and near a ball striking surface 714 of the golf club head 702. A center of gravity 707 in this location may aid in providing less lofted shots, for instance, in high wind conditions, etc. In addition, a center of gravity 707 near a toe region 712 of the club head 702 may also aid in compensating for various swing flaws that may result in a general "hook" of the ball. The central region or hub 706 of the indicator 704 is generally aligned with that center of gravity 707 and, in some arrangements, is positioned vertically aligned with the center of gravity 707, to provide a visual indication of the location of the center of gravity 707 of the particular golf club head 702. Similar to the arrangement in FIG. 6A, center of gravity 707 merely indicates a horizontal position of the center of gravity and not necessarily the vertical location of the center of gravity.

Similar to the arrangement shown in FIG. 6A, the indicator 704 includes a plurality of legs 708 extending outward from the hub 706 to a perimeter 710 of the golf club head 702. In some arrangements, the indicator 704 may be formed to not only indicate a location of the center of gravity 707 of the golf club head 702, but may also distribute a portion of the weight associated with the golf club head 702 in order to adjust or move the center of gravity 707 of the golf club head 702. For instance, as discussed above, the indicator 704 may be formed of materials heavier or more dense than the remainder of the club head 702 in order to lower the center of gravity 707 of the club head 702 (i.e., move the center of gravity more proximal the sole of the club head). Additionally or alternatively, a portion of the indicator 704, such as the hub portion 706, may be formed of a heavier or more dense material in order to consolidate a portion of the weight associated with the club head 702 near the toe region 712, as shown in FIG. 7A.

FIG. 7B is a top view of the golf club head 702 of FIG. 7A. The center of gravity 707 is indicated near a toe region or edge 712 of the golf club head 702 and near the ball striking surface 714, similar to the location indicated by the indicator 704 in FIG. 7A. Similar to the arrangements of FIGS. 6A and 6B, the location of the center of gravity 707 may vary in a vertical direction (i.e., closer to the crown or sole of the club head), but it is generally positioned below and aligned with the hub portion 706 of the indicator 704, as shown in FIGS. 7A and 7B when the club head is oriented at its designed lie angle at a ball address orientation (e.g., as shown in FIG. 7B).

In some arrangements, the indicator 704 may be removable from a club head 702 and/or interchangeable. That is, a player, club fitter, etc., may wish to adjust the center of gravity 707 for a club head 702 and, accordingly, may remove an indicator 704 that is weighted to redistribute weight associated with the club head 702 and shift the center of gravity 707. For example, an indicator 704 may be weighted to concentrate weight near the toe region or edge 712 and ball striking surface 714 to provide a center of gravity 707 as shown in FIGS. 7A and 7B. In order to move or shift that center of gravity 707 to another location, such as the center of the club head as shown in FIGS. 6A and 6B, the indicator 704 may be removed and replaced with an indicator 604 formed to shift the center of gravity to, in one example, a center of the club head, as shown in FIGS. 6A and 6B. The indicators may be connected to the club head using various mechanical fasteners, such as screws (such as screws 611, 711), bolts, etc., snap fits, and the like. These fastening mechanisms may releasably connect the indicators to the club heads to permit interchangeability of the indicators. This interchangeability may allow a player to alter the performance characteristics of a club in order to accommodate various environmental conditions, swing flaws, etc. and provides greater customization capabilities.

Figure 8A:
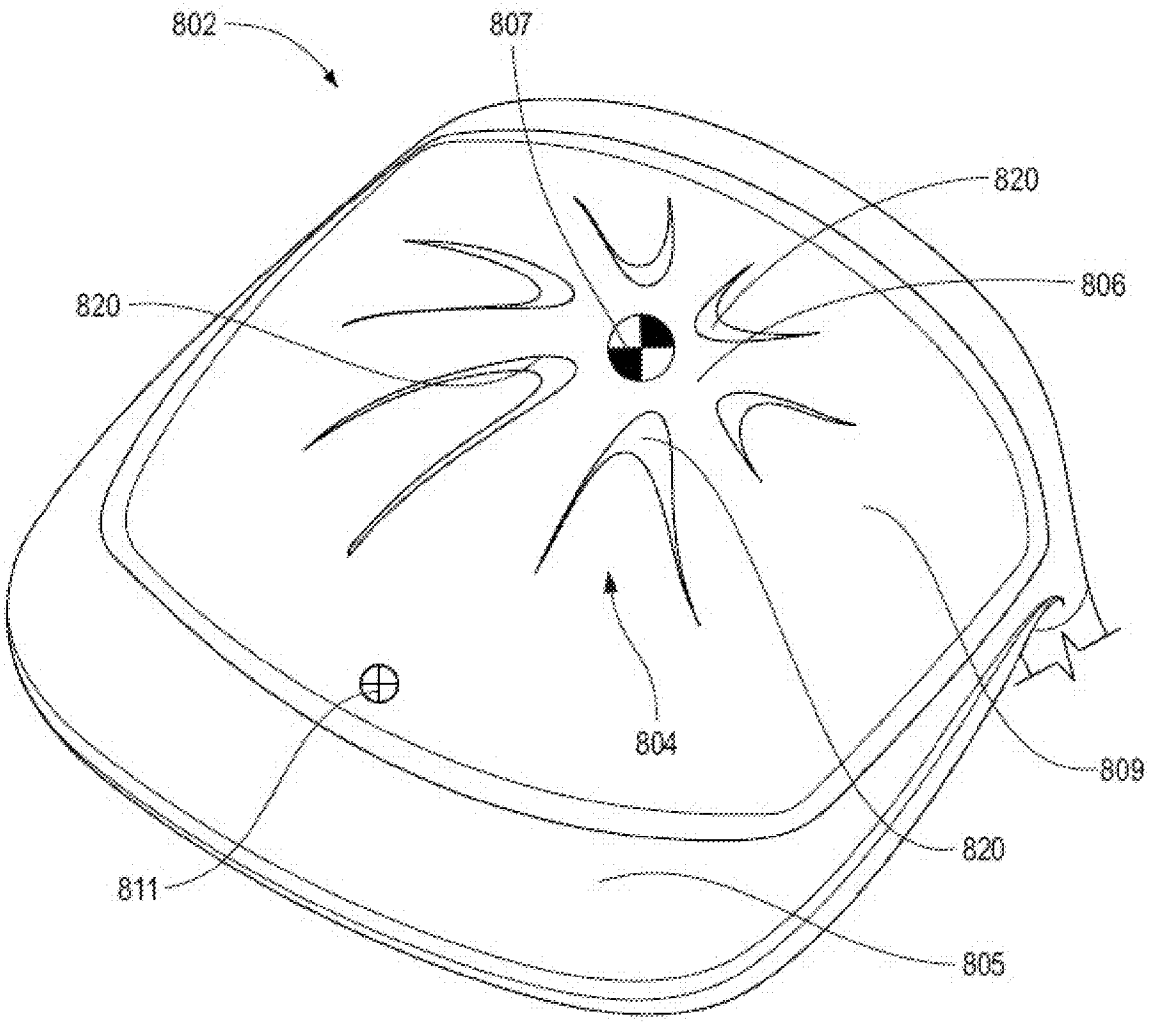
FIGS. 8A and 8B illustrate yet another example wood-type golf club head including an indicator providing a visual indication of the location of the center of gravity of the golf club head structure according to some examples of this disclosure.
Figure 8B:
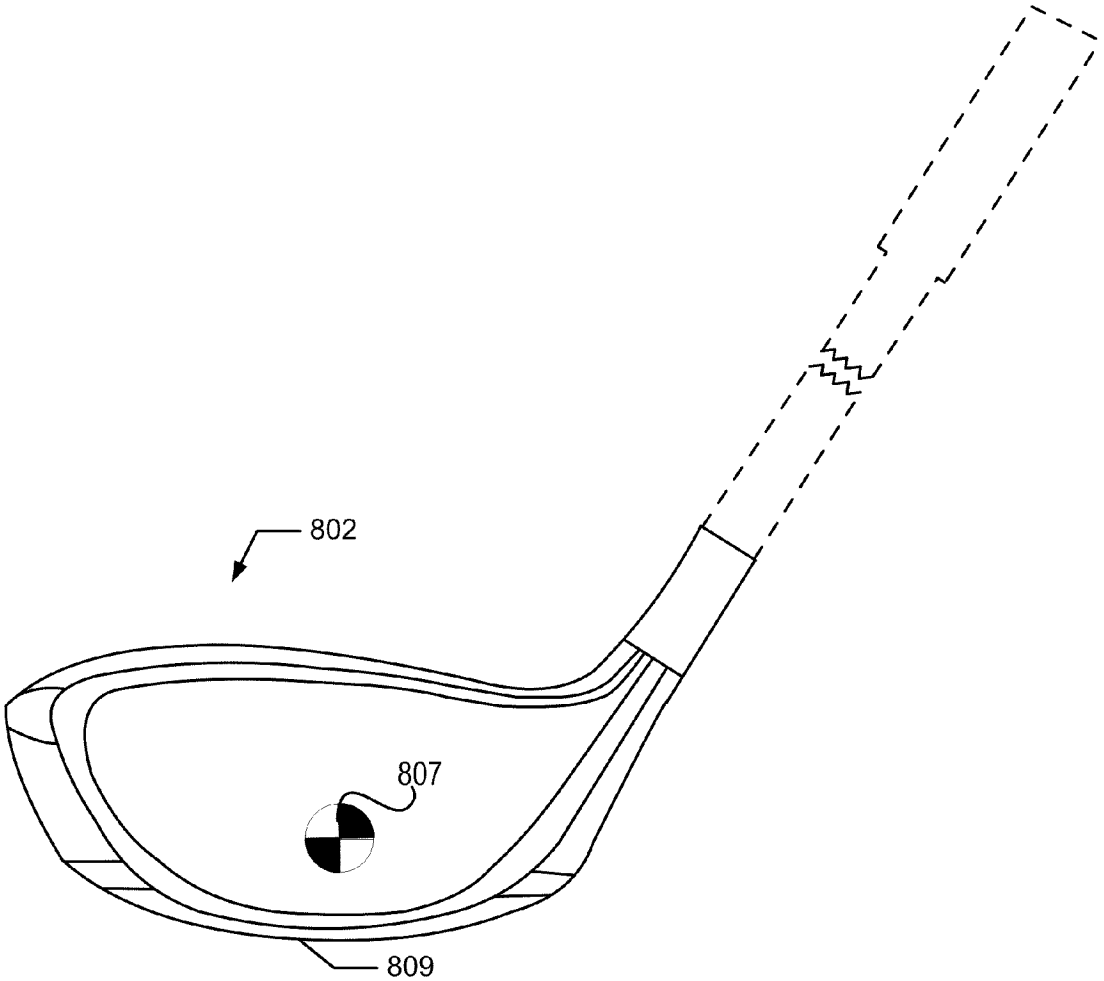

FIGS. 8A and 8B illustrate another arrangement of a wood-type golf club head 802 having an indicator 804 identifying a location of a center of gravity 807 of the golf club head 802. The arrangement shown includes sole plate 809 arranged on or arranged to provide a sole portion 805 of the golf club head 802. In some arrangements, the sole plate 809 may be formed separately from the remainder of the club head 802 and may be connected to the club head 802 using known methods of attachment, including cements, adhesives, mechanical fasteners, and the like. In other arrangements, the sole plate 809 may be integrally formed with the club head 802, for instance, as a single piece. As shown in FIG. 8A, the sole plate 809 may be formed just as a portion of the sole, e.g., it may be attached to a perimeter frame member that forms at least some of the outer periphery of the sole.

The sole plate 809 further includes a plurality of recesses 820 formed therein. The recesses 820 may extend through the entire thickness of the sole plate 809 or, in some arrangements, may extend through a portion of the thickness of the sole plate 809. The recesses 820 may, in some examples, be shaped similar to an arrow pointing to the center of gravity 807 of the club head 802. For instance, the recesses 820 generally point to the hub 806 area which may be generally vertically aligned with the center of gravity 807 of the golf club head 802 in order to provide a visual indication of the location of the center of gravity 807, as described above.

In some arrangements, the sole plate 809 may be formed of a material that is heavier or more dense than the remainder of the club head 802 in order to lower the center of gravity (i.e., move the center of gravity more proximal the sole of the club head). FIG. 8B illustrates one example vertical position of the center of gravity 807 of the club head 802. As shown, the center of gravity 807 is more proximal the sole plate 809 than the center of gravity 607 indicated in FIG. 6B. The additional weight associated with the sole plate 809 may shift of a portion of the overall weight of the club head 802 lower, thereby lowering the center of gravity 807. This lower center of gravity 807 may aid in providing more lofted shots.

In some examples, the sole plate 809 may be interchanged with sole plates having alternate configurations, e.g., recesses in various shapes, sizes positions, a hub in an alternative location, etc., similar to the interchangeability described above with respect to FIGS. 7A and 7B. For instance, the sole plate 809 may be removably connected to the golf club head 802, such as via fasteners including at least screws (such as screw 811), bolts, snap fits, and the like. This removable connection may aid in interchanging sole plate 809 with another sole plate.

Figure 9A:
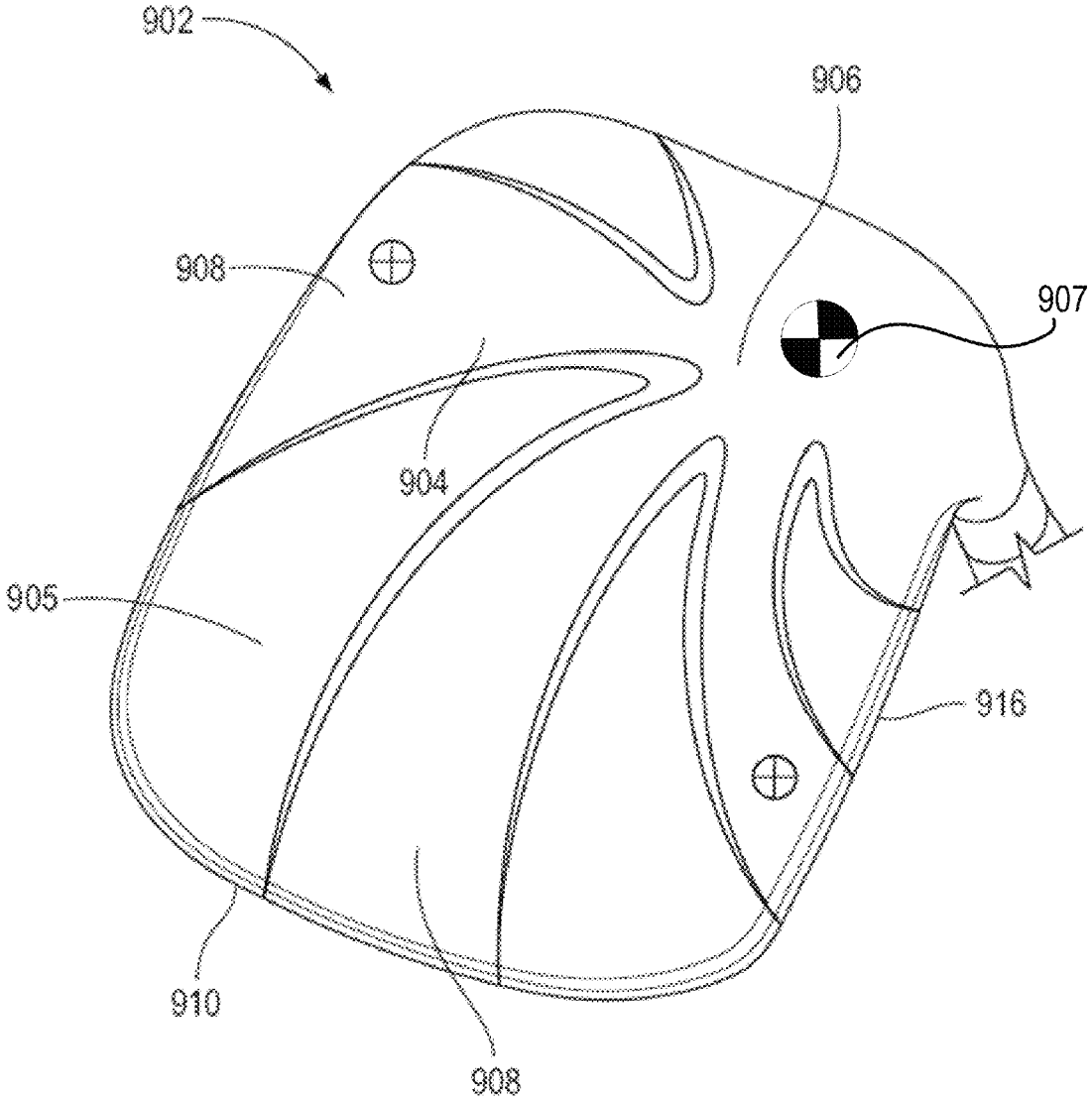
FIGS. 9A and 9B illustrates another example wood-type golf club head structure including an indicator providing a visual indication of the location of the center of gravity of the golf club head according to at least some examples of this disclosure.
Figure 9B:
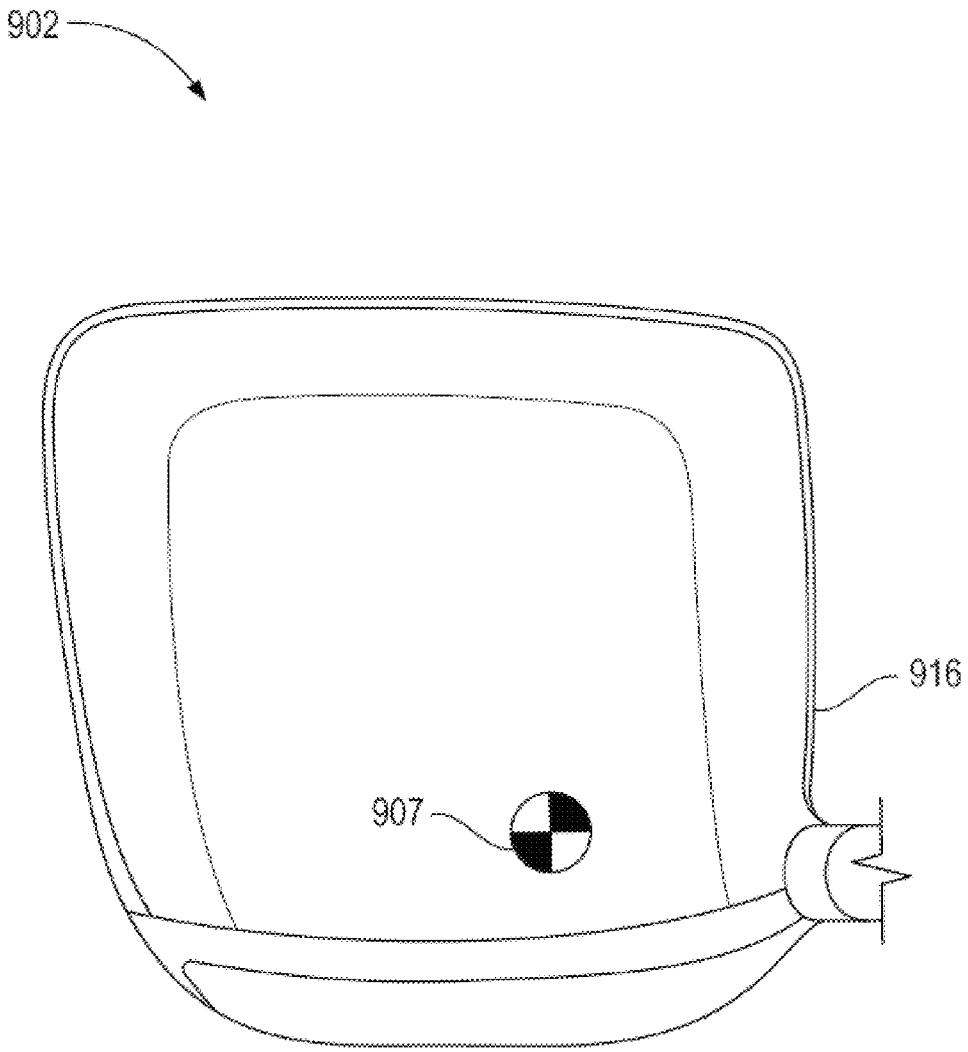

FIGS. 9A and 9B illustrate yet another arrangement of a wood-type golf club head 902 having an indicator 904 providing a visual indication of the location of the center of gravity 907 of the golf club head 902. As shown in FIG. 9A, the indicator 904 includes a central portion or hub 906 region and a plurality of legs 908 extending outward therefrom toward a perimeter 910 of the golf club head 902. The hub 906 portion may be generally vertically aligned with the center of gravity, e.g., under the conditions described above. For instance, in the arrangement of FIGS. 9A and 9B, the center of gravity 907 may be located proximal a heel region or edge 916 of the golf club head 902. Accordingly, the hub 906 portion of the indicator 904 is generally located in the heel portion and may be positioned vertically below the center of gravity 907 when the club head is oriented at its designed lie angle at a ball address orientation (e.g., with the sole 905 in contact with the ground surface), as described above. Also, as discussed above, the indicator 904 may be configured to shift or adjust the center of gravity 907. For instance, the indicator 904 or portions thereof may be formed of heavier or more dense materials in order to redistribute weight associated with the club head 902 to shift the center of gravity 907.

Although various indicator shapes and arrangements have been described herein and shown in the figures, various other arrangements may be used without departing from the invention. In some examples, the indicator may include a "star" shape, a "spider" shape, etc.

Additionally or alternatively, wood-type golf club head structures may include other indicator arrangements provided to indicate a location of a center of gravity of a golf club head. Some arrangements described in U.S. patent application Ser. No. 12/416,735 entitled "Golf Clubs and Golf Club Heads," filed Apr. 1, 2009 and incorporated herein by reference in its entirety, may be used in conjunction with wood-type golf club heads, similar to the arrangements described herein.

III. Conclusion

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 through 9B may be used individually and/or in any combination or subcombination without departing from this disclosure.

What is claimed is:

1. A golf club head, comprising:

a wood-type golf club head body; and an indicator formed in a sole portion of the wood type golf club head body, the indicator extending across substantially all of the sole portion and including:

a hub positioned vertically below the center of gravity when the golf club head is oriented at its design lie angle at a ball address orientation, the hub providing a visual indication of a location of the center of gravity; and a plurality of legs extending outward from the hub toward a perimeter of the golf club head body.

2. The golf club head of claim 1, wherein each of the legs of the plurality of legs is tapered.

3. The golf club head of claim 2, wherein each of the legs of the plurality of legs has a width that is greater at an end proximal a perimeter of the golf club head than at an end proximal the hub portion.

4. The golf club head of claim 1, wherein the hub is positioned in a center of the sole portion of the golf club head body.

5. The golf club head of claim 1, wherein the hub is positioned closer to a toe edge of the golf club head body than to a heel edge of the golf club head body.

6. The golf club head of claim 1, wherein the hub is positioned closer to a heel edge of the golf club head body than to a toe edge of the golf club head body.

7. The golf club head of claim 1, wherein the indicator extends from an area at or proximate to a toe edge of the wood-type golf club head body to an area at or proximate to a heel edge of the wood-type golf club head body and from an area at or proximate to a forward edge of the ball striking surface of the golf club head to an area at or proximate to a rear edge of the golf club head.

8. The golf club head of claim 1, wherein the wood-type golf club head body is formed at least in part from a first material and the indicator is formed at least in part from a second material, different from the first material.

9. The golf club head of claim 8, wherein the second material is more dense than the first material.

10. The golf club head of claim 8, wherein the first material includes at least one of carbon fiber composite materials, aluminum, aluminum alloys, titanium, titanium alloys, magnesium and magnesium alloys.

11. The golf club head of claim 8, wherein the second material includes at least one of copper, tungsten, carbon steel, lead, and stainless steel.

12. The golf club head of claim 1, wherein the golf club head is connected to a shaft to form a golf club.

13. A golf club head, comprising:

a wood-type golf club head body including at least a sole portion, a top portion, a toe edge, a heel edge, a ball striking portion and a rear edge; and an indicator formed in the wood-type golf club head body indicating a center of gravity of the golf club head, the indicator at least partially formed in the sole portion of the club head body and extending across substantially all of the sole portion of the club head body.

14. The golf club head of claim 13, wherein the indicator extends from an area at or proximate to the toe edge of the wood-type golf club head body to an area at or proximate to the heel edge of the wood-type golf club head body and from an area at or proximate to the ball striking portion of the wood-type golf club head body to an area at or proximate to the rear edge of the wood-type golf club head body.

15. The golf club head of claim 13, wherein the indicator includes a hub portion that is generally vertically aligned with the center of gravity of the golf club head when the golf club head is oriented at its designed lie angle at a ball address orientation.

16. The golf club head of claim 15, wherein the hub portion is located in a center of the sole portion of the golf club head.

17. The golf club head of claim 15, wherein the hub portion is located closer to a toe edge of the golf club head than to a heel edge of the golf club head.

18. The golf club head of claim 15, wherein the hub portion is located closer to a heel edge of the golf club head than to a toe edge of the golf club head.

19. The golf club head of claim 15, wherein the indicator further includes a plurality of legs extending outward from the hub portion toward a perimeter of the golf club head.

20. The golf club head of claim 19, wherein each of the legs includes a first end having a first leg width and a second end having a second leg width, the second leg width being different from the first leg width.

21. The golf club head of claim 20, wherein the first end is located proximal the hub portion of the indicator and the second end is located proximal the perimeter of the golf club head.

22. The golf club head of claim 21, wherein the second leg width is greater than the first leg width.

23. The golf club head of claim 13, wherein at least a portion of the indicator is formed of a material that is heavier than a material used to form at least a majority of the golf club head body.

24. The golf club head of claim 13, wherein the golf club head is connected to a shaft to form a golf club.

25. A golf club head, comprising:

a wood-type golf club head body including a least a heel edge, a toe edge and a ball striking face; and a sole plate connected to the club head body and including an indicator providing a visual indication of a center of gravity of the golf club head, the indicator including a hub portion generally vertically aligned with the center of gravity when the golf club head is oriented at its designed lie angle at a ball address orientation, the indicator extending across substantially all of the sole portion of the club head body.

26. The golf club head of claim 25, wherein the sole plate further includes a plurality of recesses formed therein.

27. The golf club head of claim 26, wherein the plurality of recesses extends through an entire thickness of the sole plate.

28. The golf club head of claim 26, wherein the plurality of recesses extends through a portion of the thickness of the sole plate.

29. The golf club head of claim 26, wherein the plurality of recesses is configured to aid in indication of the center of gravity of the golf club head.

30. The golf club head of claim 26, wherein the plurality of recesses is shaped similarly to arrow heads.

31. The golf club head of claim 25, wherein the club head body is formed of a first material and the sole plate is formed of a second material, the second material being heavier than the first material.

* * * * *